US007840304B2

(12) United States Patent
Mizuno

(10) Patent No.: US 7,840,304 B2
(45) Date of Patent: Nov. 23, 2010

(54) EMBROIDERY DATA PROCESSING APPARATUS AND EMBROIDERY DATA PROCESSING PROGRAM RECORDED ON COMPUTER-READABLE RECORDING MEDIUM

(75) Inventor: Masahiro Mizuno, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 925 days.

(21) Appl. No.: 11/716,652

(22) Filed: Mar. 12, 2007

(65) Prior Publication Data

US 2007/0213865 A1 Sep. 13, 2007

(30) Foreign Application Priority Data

Mar. 13, 2006 (JP) ..... 2006-066871
Dec. 18, 2006 (JP) ..... 2006-339687

(51) Int. Cl.
*D05C 5/02* (2006.01)

(52) U.S. Cl. ..... 700/138; 112/102.5; 112/103; 112/470.01; 112/470.06

(58) Field of Classification Search ..... 700/136–138; 112/102.5, 103, 470.01, 470.06, 475.19
See application file for complete search history.

(56) References Cited

U.S. PATENT DOCUMENTS 5,558,031 A * 9/1996 Muto et al. ..... 112/102.5
5,865,133 A * 2/1999 Herbach et al. ..... 112/102.5
5,943,972 A * 8/1999 Hirata ..... 112/102.5
5,960,727 A * 10/1999 Miyasako et al. ..... 112/102.5
6,237,516 B1 * 5/2001 Wakayama ..... 112/102.5
6,256,551 B1 7/2001 Muto
6,600,966 B1 * 7/2003 Bailie ..... 700/138
6,983,193 B2 1/2006 Mizuno et al.
7,210,419 B2 * 5/2007 Naka et al ..... 112/470.06
2005/0234584 A1 * 10/2005 Mizuno et al. ..... 700/138
2006/0027154 A1 * 2/2006 Naka et al. ..... 112/470.01

FOREIGN PATENT DOCUMENTS

JP A 11-057260 3/1999
JP A 2000-024350 1/2000
JP A 2000-107477 4/2000
JP A 2005-279068 10/2005

* cited by examiner

*Primary Examiner*—Gary L Welch
*Assistant Examiner*—Nathan E Durham
(74) *Attorney, Agent, or Firm*—Oliff & Berridge, PLC

(57) ABSTRACT

An embroidery data processing apparatus and an embroidery data processing program that creates embroidery data usable by an embroidery sewing machine to sew an embroidery pattern that includes a plurality of partial patterns. The embroidery data processing apparatus and program store a maximum sewing region; set a plurality of unit embroidery regions; and modify a size of each of the plurality of unit regions based on the size of the maximum sewing region and a position and a size of each of the plurality of partial patterns contained within the plurality of unit embroidery regions. The embroidery data processing apparatus and program create the embroidery data of a part or a whole of the embroidery pattern being contained within the modified plurality of unit embroidery regions and output the embroidery data.

18 Claims, 31 Drawing Sheets

EMBROIDERY DATA PROCESSING APPARATUS AND EMBROIDERY DATA PROCESSING PROGRAM RECORDED ON COMPUTER-READABLE RECORDING MEDIUM

CROSS-REFERENCE TO RELATED APPLICATION

This application claims priority from JP 2006-066871, filed Mar. 13, 2006, and JP 2006-339687, filed Dec. 18, 2006, the contents of which are hereby incorporated by reference in their entireties.

BACKGROUND

The present disclosure relates to an embroidery data processing apparatus that creates embroidery data required to sew an embroidery pattern by using an embroidery sewing machine and an embroidery data processing program recorded on a computer-readable recording medium required to cause a computer to function as the embroidery data processing apparatus.

Conventionally, to create embroidery data required for an embroidery sewing machine to embroider a pattern, it has been necessary to specify the embroidery data so that the embroidery pattern may be contained in a sewing region restricted by an embroidery frame of the embroidery sewing machine. To solve this problem, to enable creating embroidery data of an original graphic larger than a maximum sewing size of an embroidery sewing machine, the original pattern has been divided into several patterns each of which is not larger than the maximum sewing size so that embroidery data may be created for each of the divided patterns (e.g., Japanese Patent Application Laid Open Publication No. Hei 11-57260).

SUMMARY

However, embroidery data processing apparatus of Japanese Patent Application Laid Open Publication No. Hei 11-57260 sets a plurality of unit embroidery regions from an original pattern, and distributes partial patterns, which constitute the original pattern, to these unit embroidery regions. In such a case, because the set unit embroidery regions have a uniform size, the partial patterns may be divided in some cases including unnecessary cases depending on a size or a position of the partial patterns. Thus, the sewing quality may be degraded.

Various exemplary embodiments of the broad principles derived herein provide an embroidery data processing apparatus that may set a size of a unit embroidery region in accordance with a partial pattern and an embroidery data processing program that is recorded on a computer-readable recording medium.

Exemplary embodiments provide an embroidery data processing apparatus that includes: a storage device that stores a maximum sewing region, a size of the maximum sewing region having an upper limit; a region setting device that sets a plurality of unit embroidery regions, each of the plurality of unit embroidery regions having a size not larger than the upper limit of the maximum sewing region stored in the storage device; a region modification device that modifies a size of each of the plurality of unit embroidery regions set by the region setting device, based on the size of the maximum sewing region, and a position and a size of the plurality of partial patterns contained within each of the plurality of unit embroidery regions, a part or a whole of the each of the plurality of partial patterns being contained within the plurality of unit embroidery regions; a data creation device that creates the embroidery data of a part or a whole of the embroidery pattern being contained within the plurality of unit embroidery regions modified by the region modification device; and an output device that outputs the embroidery data created by the data creation device.

Exemplary embodiments provide an embroidery data processing program recorded on a computer-readable medium. The program includes: instructions for storing a maximum sewing region, a size of the maximum sewing region having an upper limit; instructions for setting a plurality of unit embroidery regions, each of the plurality of unit embroidery regions having a size not larger than the upper limit of the maximum sewing regions stored in said the instructions for storing; instructions for modifying a size of each of the plurality of unit embroidery set in the instructions for setting, based on the maximum sewing region and a position and a size of each of the plurality of partial patterns, a part or a whole of the each of the plurality partial patterns being contained within the plurality of unit embroidery regions; instructions for creating embroidery data of a part or a whole of the embroidery pattern being contained within the plurality of unit embroidery regions modified in the instructions for modifying; and instructions for outputting the embroidery data created in the instructions for creating.

Exemplary embodiments provide an embroidery data processing apparatus that includes: a storage device that stores a maximum sewing region, a size of the maximum sewing region having an upper limit; a control device that sets a plurality of unit embroidery regions, each of the plurality of unit embroidery regions having a size not larger than the upper limit of a size of the maximum sewing region stored in the storage device, modifies a size of each of the plurality of unit embroidery regions based on the maximum sewing region and a position and a size of each of the plurality of partial patterns, a part or a whole of the each of the plurality of partial patterns being contained within the plurality of unit embroidery regions, and creates the embroidery data of a part or a whole of the embroidery pattern being contained within the plurality of unit embroidery regions after modification; and an output device that outputs the embroidery data created by the control device.

BRIEF DESCRIPTION OF THE DRAWINGS

Exemplary embodiments will be described below in detail with reference to the accompanying drawings in which.

DETAILED DESCRIPTION OF EMBODIMENTS

Hereinafter an embroidery data processing apparatus 1 according to exemplary embodiments will be described with reference to drawings. The embroidery data processing apparatus 1 of the disclosure may be used to create and edit embroidery data, which may be supplied to an embroidery sewing machine 3 shown in FIG. 1. The embroidery sewing machine 3 will be outlined below with reference to FIG. 1.

Figure 1:
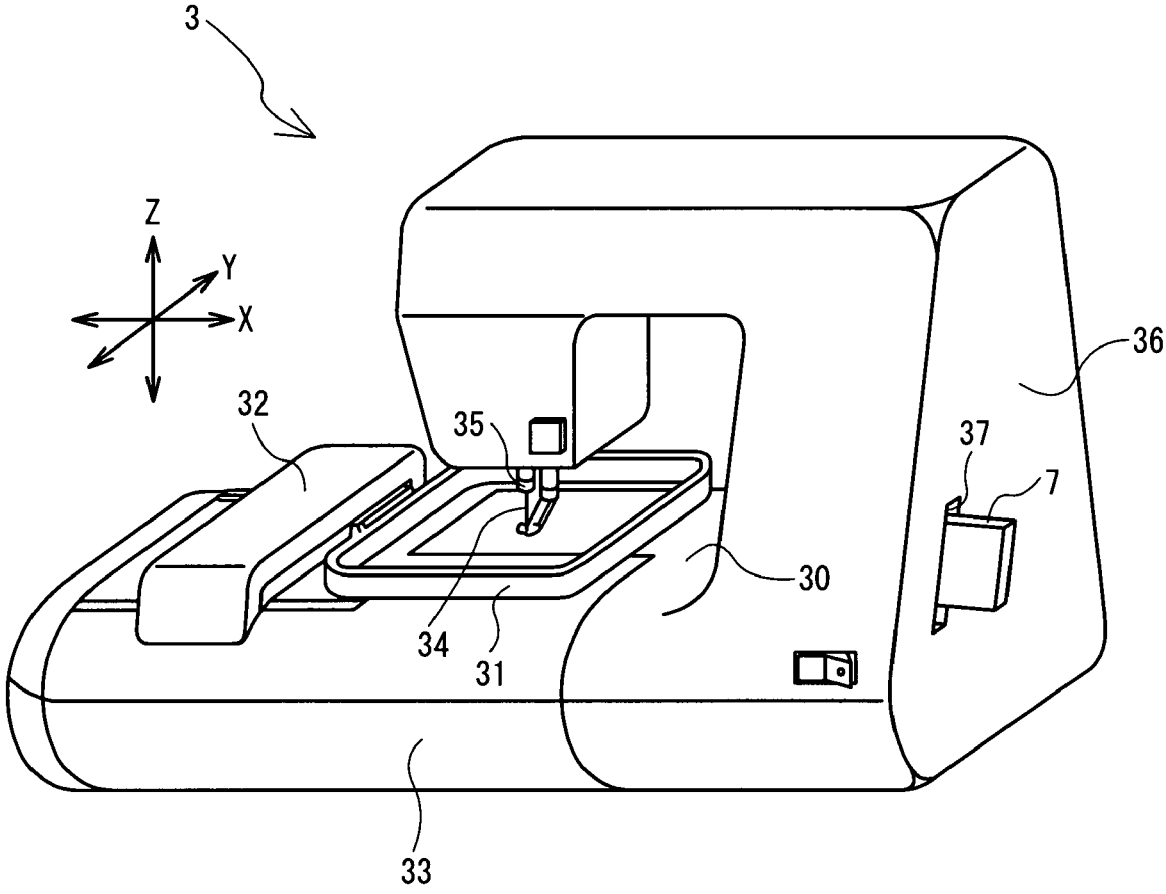
FIG. 1 is an external view of an embroidery sewing machine.

As shown in FIG. 1, the embroidery sewing machine 3 may move an embroidery frame 31 to a predetermined position, indicated by an X-Y coordinate system specific to the apparatus, by using a Y-directional drive section 32 and an X-directional drive mechanism (not shown), which may be contained within a body case 33. The embroidery frame 31 may be placed on a sewing machine bed 30 to hold a work cloth to be embroidered. Meanwhile, by using a sewing needle 34 and a shuttle mechanism (not shown), a predetermined design may be embroidered onto this work cloth. The Y-directional drive section 32, X-directional drive mechanism and needle bar 35, etc., may be controlled by a control device (not shown) that includes, for example, a microcomputer that is built into the embroidery sewing machine 3.

The embroidery sewing machine 3 may include a memory card slot 37 that is, for example, formed on a side surface of a pillar 36. By inserting a memory card 7 that stores embroidery data into the memory card slot 37, the embroidery data may be supplied from outside. The embroidery data may include a color code, information that indicates an embroidery position and a size, and stitch data, which represents stitches for expressing a design by embroidery. The control device of the embroidery sewing machine 3 may embroider a design automatically.

Figure 2:
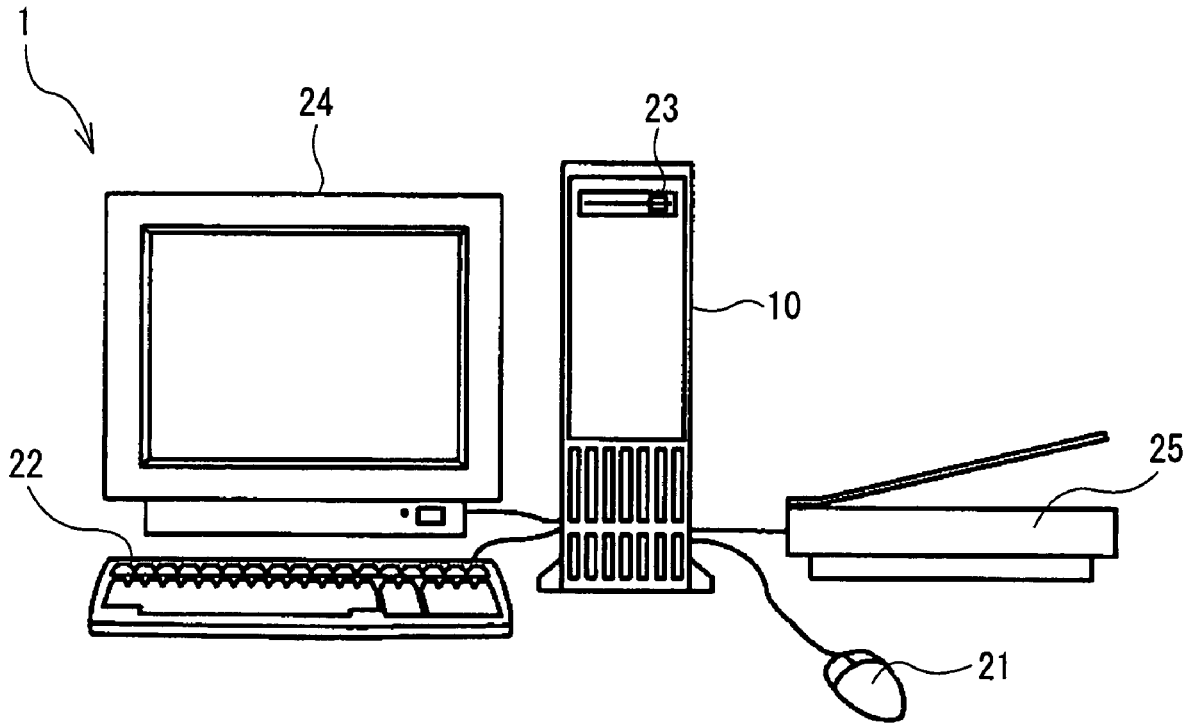
FIG. 2 is an overall configuration diagram showing a physical configuration of an embroidery data processing apparatus.

Next, a configuration of the embroidery data processing apparatus 1 will be described with reference to the drawings. As shown in FIG. 2, the embroidery data processing apparatus 1 serves to create and edit embroidery data that may be supplied to the embroidery sewing machine, as described above. The apparatus 1 may include a main frame 10 and components connected to the main frame 10, such as: a mouse 21; a keyboard 22; a memory card connector 23; a display device 24; and an image scanner 25.

Figure 3:
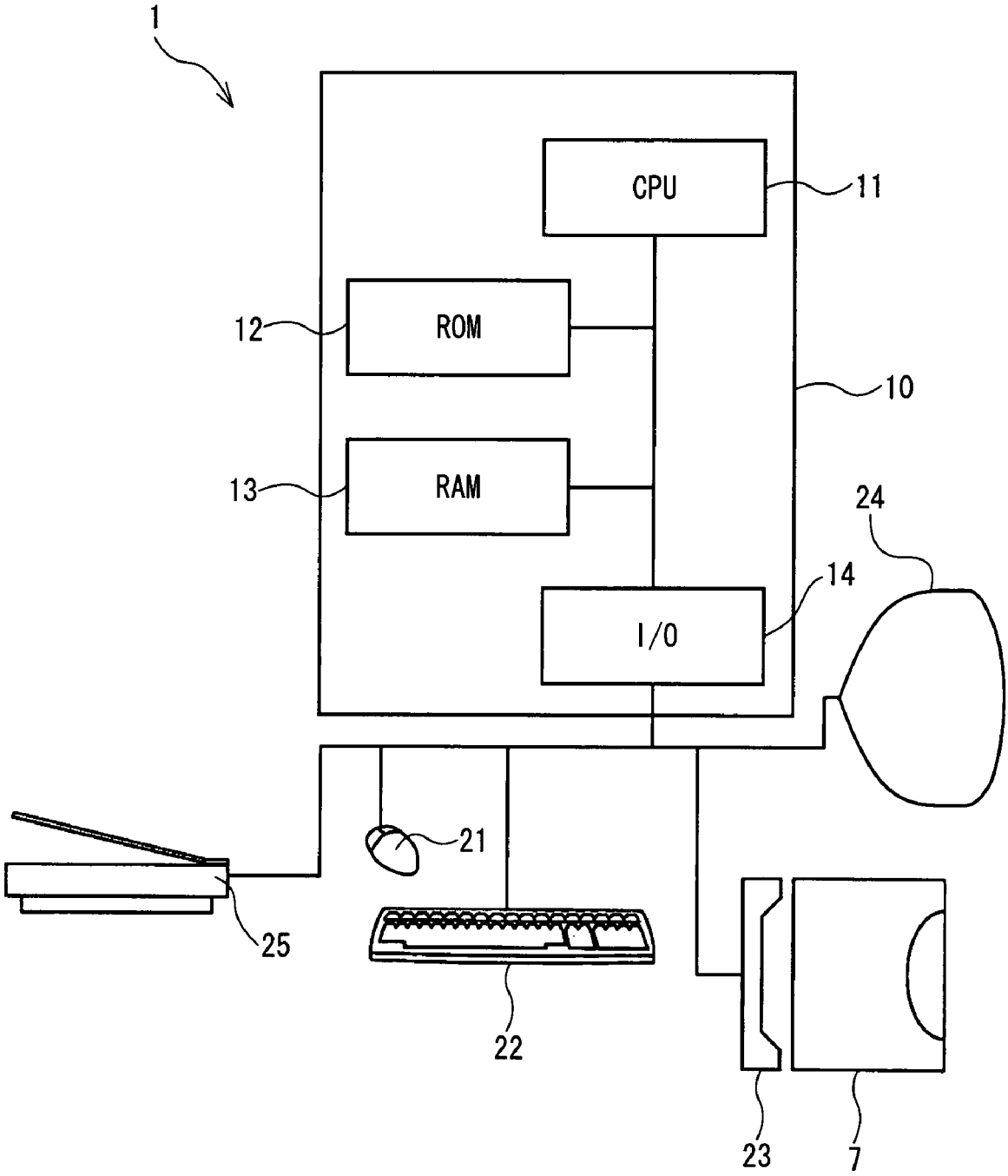
FIG. 3 is a block diagram showing an electrical configuration of the embroidery data processing apparatus.

Further, as shown in FIG. 3, the main frame 10 may include a CPU11, a ROM12, a RAM13, and an I/O interface 14. To the I/O interface 14, the mouse 21, the keyboard 22, the memory card connector 23, the display device 24, and the image scanner 25 may be connected. The memory card 7 may be connected to the memory card connector 23. The embroidery data created by later-described embroidery data creation processing may be written into the memory card 7 and outputted to the embroidery sewing machine 3.

The CPU11 may perform a variety of arithmetic operations and processing in accordance with an embroidery data creation program of the present disclosure stored in the ROM12, which may be a read only memory. If the main frame 10 is dedicated to embroidery, the program may be stored in the ROM12 beforehand. On the other hand, if the main frame 10 is general-purpose (e.g., a personal computer, etc.), the program stored on a hard disk, for example, may be read into the RAM13 to be executed.

Figure 4:
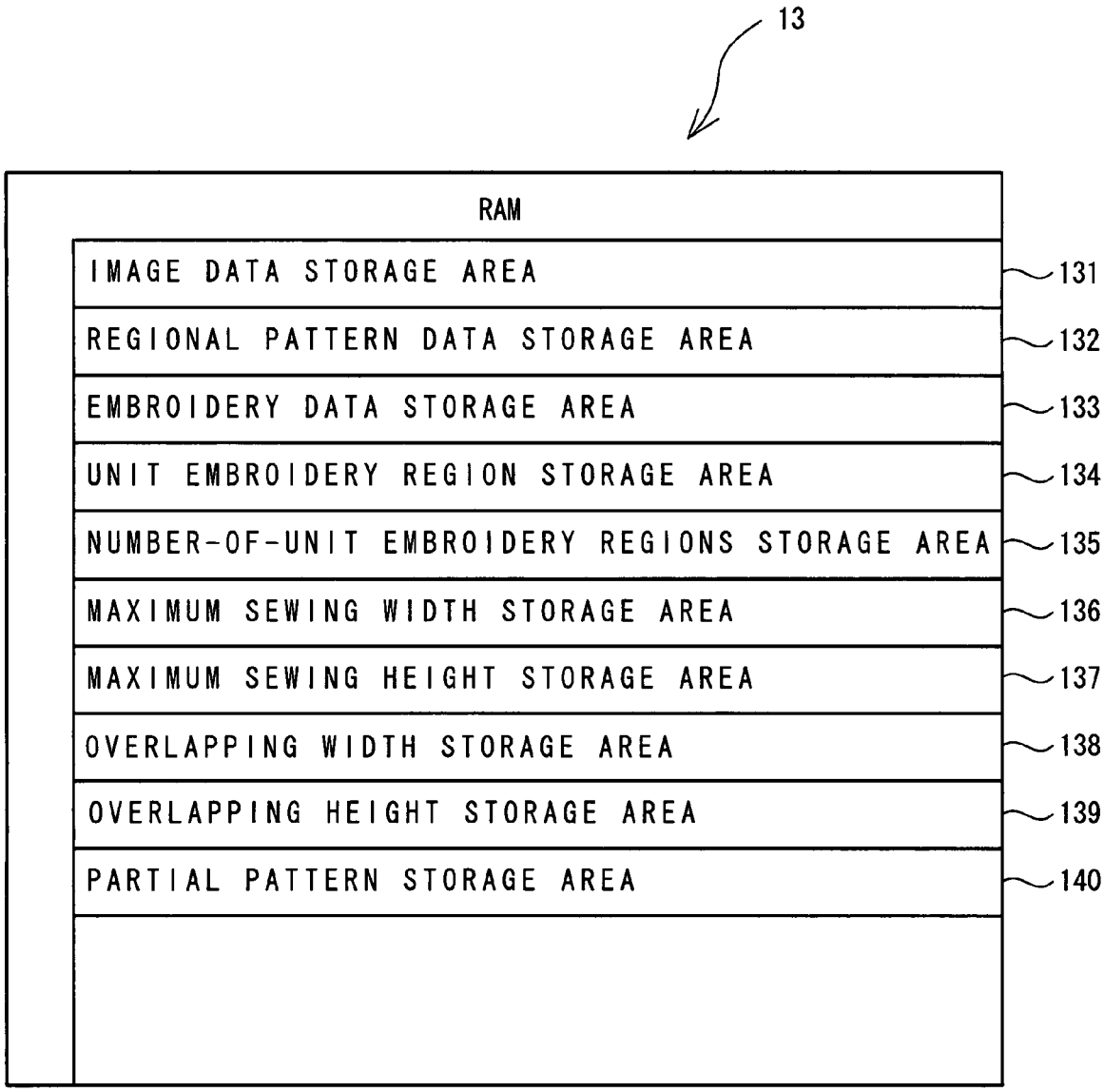
FIG. 4 is a configuration diagram showing storage areas of a RAM.

Further, as shown in FIG. 4, the RAM13, which is a random access memory, may include an image data storage area 131, a regional pattern data storage area 132, an embroidery data storage area 133, a unit embroidery region storage area 134, a number-of-unit embroidery regions storage area 135, a maximum sewing width storage area 136, a maximum sewing height storage area 137, an overlapping width storage area 138, a overlapping height storage area 139, and a partial pattern storage area 140. The RAM13 may also include other storage areas (not shown).

The image data storage area 131 may store image data read through the image scanner 25 or image data read from an external storage device, such as a hard disk, a CD-ROM, and a CD-R (not shown). The regional pattern data storage area 132 may store image data of regional patterns, which are created by dividing an image by boundaries of the unit embroidery regions. The embroidery data storage area 133 may store a plurality of embroidery data pieces. The unit embroidery region storage area 134 may store a plurality of unit embroidery regions. The number-of-unit embroidery regions storage area 135 may store the number of the unit embroidery regions (N). The maximum sewing width storage area 136 may store a maximum sewing width (W), which is a horizontal length of the maximum sewing region of the sewing machine. The maximum sewing height storage area 137 may store a maximum sewing height (H), which is a vertical length of the maximum sewing region of the sewing machine. It is noted that a "width" hereinafter refers to a horizontal (x-directional) length, while a "height" refers to a vertical (y-directional) length. The overlapping width storage area 138 may store an overlapping width (w), which is a length of the overlapping part between the horizontally adjacent unit embroidery regions. The overlapping height storage area 139 may store an overlapping height (h), which is a length of the overlapping part between the vertically adjacent unit embroidery regions. The partial pattern storage area 140 may store a partial pattern, which may be contained within the set unit embroidery region.

Prior to embroidery data creation processing, the CPU11 may read out a maximum sewing width (W), a maximum sewing height (H), an overlapping width (w), and an overlapping height (h). The CPU11 may then store each of these parameters, respectively, into the maximum sewing width storage area 136, the maximum sewing height storage area 137, the overlapping width storage area 138, and the overlapping height storage area 139 in the RAM13. For example, each of these parameters may read out from the ROM12 in which they were stored beforehand, or from a hard disk device or a CD-ROM (not shown), in which they have been stored.

Next, embroidery data creation processing according to a first embodiment will be described with reference to FIGS. 5-12. The processing may be performed in the embroidery data processing apparatus 1 having the above-described configuration.

Figure 5:
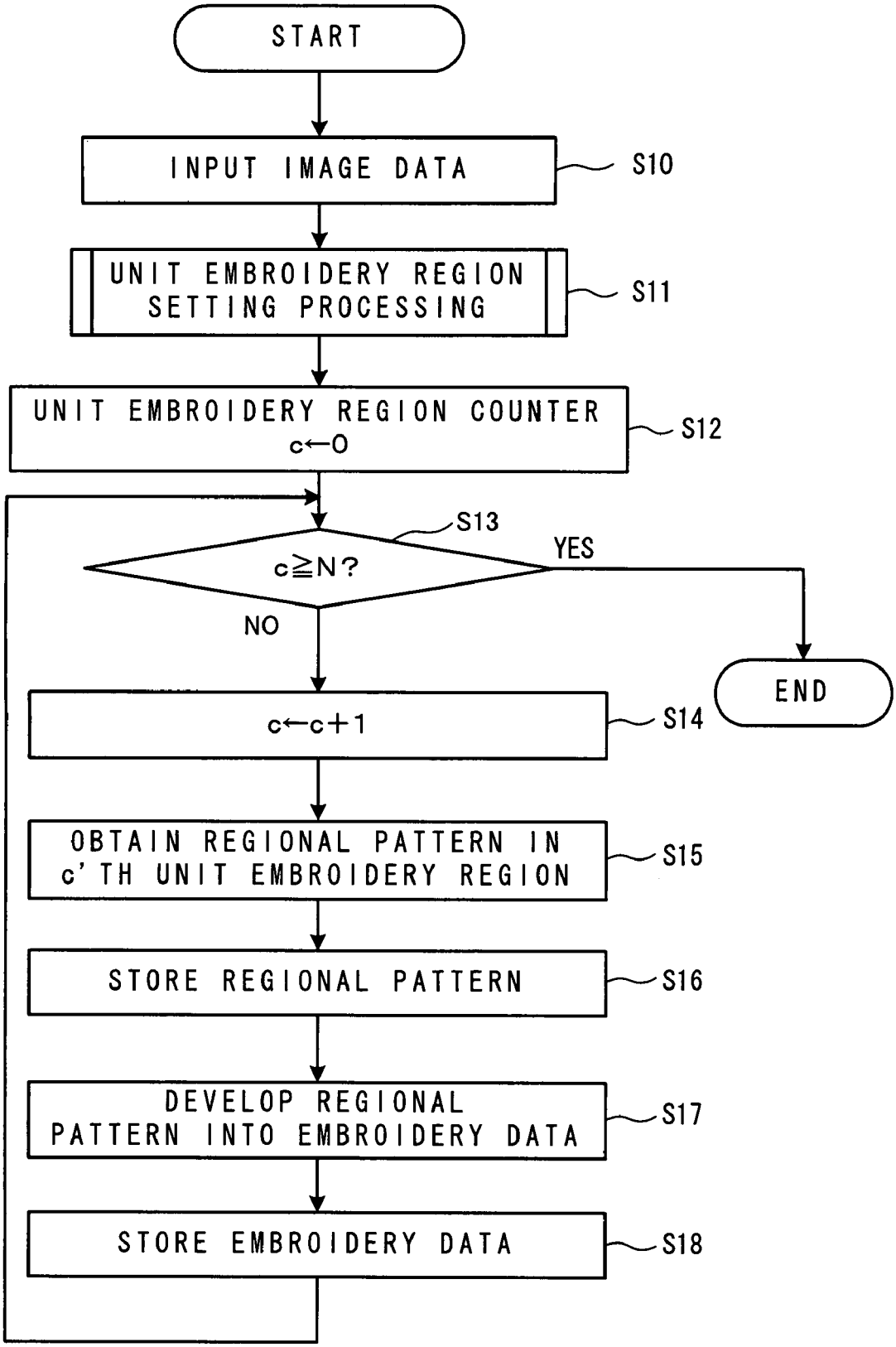
FIG. 5 is a flowchart of a main routine of embroidery data creation processing.

As shown in FIG. 5, first, the image data 100, from which an embroidery pattern originates, may be inputted and the input image data 100 may be stored in the image data storage area 131 (S10). The image data 100 may be inputted from any one of a variety of storage media such as a flexible disk, a hard disk, a DVD, or a CD-ROM, which stores the image data 100 beforehand. Alternatively, a predetermined handwritten or printed original design may be read by the image scanner 25 to provide extracted image data. The extracted image data may be stored in the image data storage area 131 as the image data 100.

Next, unit embroidery region setting processing may be invoked and executed (S11). Through this processing, a sewing region for one sewing process may be set when the size of the input image exceeds the maximum sewing region. Details of the unit embroidery region setting processing will be described later with reference to FIG. 6.

When the unit embroidery region setting processing has been completed, the CPU11 may set a unit embroidery region counter c to 0 (S12) to sequentially process embroidery patterns in the unit embroidery regions set in S11. First, the CPU11 may compare the number of unit embroidery regions (N) and a value of the unit embroidery region counter c to each other, thereby determining whether embroidery data has been created for all of the unit embroidery regions (S13). The number of the unit embroidery regions (N) may be obtained by the unit embroidery region setting processing (S11) and may be stored in the number-of-unit embroidery regions storage area 135 shown in FIG. 4.

If the value set to the unit embroidery region counter c is smaller than the number of the unit embroidery regions (N), that is, if any one of the unit embroidery regions has not yet been processed (NO in S13), the CPU11 may add 1 to the unit embroidery region counter c (S14). Then, the CPU11 may obtain a regional pattern contained in the unit embroidery region that is currently being processed (c'th unit embroidery region). Specifically, the CPU11 may calculate profile lines of the regional pattern, excluding those parts that are not contained within the unit embroidery region, or, if the regional pattern is a line graphic, its shape lines (S15). Then, data of this regional pattern may be stored in the regional pattern data storage area 132 (S16).

A clipping algorithm may be employed, which is often used in a field of computer graphics, to obtain profile lines of the regional pattern or shape lines of a line graphic. For example, where profile lines of a planar graphic or shape lines of a linear graphic initially include straight lines, it is possible to use a polygon clipping algorithm for a planar graphic and a linear segment clipping algorithm for a linear graphic, respectively. Further, if profile lines of a planar graphic or shape lines of a linear graphic include a curve, this curve may be approximated with line segments first, and then the above algorithm may be applied.

The above-described line segment clipping algorithm may be, for example, a Sutherland-Cohen algorithm, a Cyrus-Beck algorithm, or any known or later-developed algorithm. Further, the polygon clipping algorithm may be, for example, a Sutherland-Hodgman algorithm, a Weiler-Atherton algorithm, or any known or later-developed algorithm.

Next, the regional pattern may be developed into embroidery data (S17) and stored in a c'th area in the embroidery data storage area 133 (S18). In this step (S17), a known or a later developed method, for creating embroidery data from profile line data or line graphic's shape line data may be employed to create embroidery data of embroidery stitches within a polygon or on a profile line. For example, a method, that is known or later-developed, for dividing, by utilizing the profile line data, an inside of a profile line into data having a shape of blocks referred to as embroidery blocks, and connecting their opposing sides with alternating stitch lines to thereby create embroidery stitches may be used. Another method, that is known or later-developed, for performing running-stitch sewing or zigzag sewing on line segments by utilizing the line graphic's shape lines data may also be used.

When the above processing is completed, the CPU11 may return to S13, to repeat the processing for creating the embroidery data of the regional patterns contained within the unit embroidery regions until it completely creates the embroidery data of the regional patterns contained within all of the unit embroidery regions. When the embroidery data of the regional patterns contained within all of the unit embroidery regions is created ($c \geqq N$) (YES in S13), the CPU11 may end the embroidery data creation processing. The created embroidery data may be stored in the memory card 7 and supplied to the embroidery sewing machine 3, which in turn performs embroidering.

Next, the unit embroidery region setting, which is performed during the embroidery data creation processing, will be described with reference to FIG. 6. After the unit embroidery region setting processing has been invoked, the CPU11 may calibrate coordinates (lower left point (x1, y1) and upper right point (x2, y2)) of a rectangle (see FIG. 9) that contains all of the image data to form an embroidery pattern (S20). For example, the CPU11 may first obtain maximum and minimum values of x-coordinates and y-coordinates of component points of profile lines or shape lines of a graphic. Then, based on these values, the CPU11 may set a value not larger than the minimum value of the x-coordinates as x1, a value not larger than the minimum value of the y-coordinates as y1, a value not smaller than the maximum value of the x-coordinates as x2, and a value not smaller than the maximum value of the y-coordinates as y2.

Next, the CPU11 may determine how many regions into which the rectangle obtained in S20 should be divided in the x- and y-directions, respectively (S21). For example, the number of divisions in the x-direction I and the number of divisions in the y-direction J may be calculated, using the ceiling function in accordance with the following equations (1) and (2):

$$I = \text{ceiling}\left(\frac{x2 - x1 - w}{W - w}\right); \text{ and} \tag{1}$$

$$J = \text{ceiling}\left(\frac{y2 - y1 - h}{H - h}\right), \tag{2}$$

where ceiling (x) indicates an arithmetic operation to obtain a minimum integer not smaller than a real number x. Further, W indicates a maximum sewing width, H indicates a maximum sewing height, w indicates an overlapping width, and h indicates a overlapping height.

Next, the CPU11 may set the unit embroidery region counter c to 1 and an x-directional unit embroidery region counter i to 0 (S22). Then, the CPU11 may determine whether i has reached the value I to thereby determine whether the processing has been completed for the x-direction (S23). If i is smaller than I (NO at S23), the CPU11 may add 1 to the x-directional unit embroidery region counter i and may set a y-directional unit embroidery region counter j to 0 (S24). During the first-time processing, for example, i may be 0 so as to always be smaller than I (NO in S23), 1 may be set to i, and 0 may be set to j (NO in S24).

Next, the CPU11 may determine whether j has reached the value J to thereby determine whether the processing is completed for the y-direction (S25). If j is smaller than J (NO in S25), the CPU11 may add 1 to the y-directional unit embroidery region counter j (S26) and then may obtain a lower left point and an upper right point of a unit embroidery region to be processed (S27). For example, the lower left point (X1, Y1) and an upper right point (X2, Y2) may be calculated, using the following equations (3)-(6):

$$X1 = x1 + (x2 - x1 - w) \times \frac{i}{I}; \tag{3}$$

$$Y1 = y1 + (y2 - y1 - h) \times \frac{j}{J}; \tag{4}$$

$$X2 = x1 + (x2 - x1 - w) \times \frac{i+1}{I} + w; \text{ and} \tag{5}$$

$$Y2 = y1 + (y2 - y1 - h) \times \frac{j+1}{J} + h, \tag{6}$$

where (x1, y1) and (x2, y2) are coordinates of the lower left point and the upper right point, respectively, of the rectangle in S20, which contains all of the image data that forms the embroidery pattern. Further, w indicates an overlapping width and h indicates an overlapping height.

Next, a rectangle having a lower left point of coordinates (X1, Y1) and an upper right point of coordinates (X2, Y2) given by X1, X2, Y1 and Y2 calculated in S27 may be stored in the c'th area in the unit embroidery region storage area 134 (S28).

Then, the CPU11 may add 1 to the unit embroidery region counter c (S29) and return to S25. The CPU11 may repeat the processing steps of S26 through S29 until j reaches the value J, that is, as long as the processing for the y-direction has not yet been completed (NO in S25).

If the processing for the y-direction is completed (YES at S25), the CPU11 may return to S23. The CPU11 may repeat processing steps of S24 through S29 until i reaches the value I, that is, as long as the processing for the x-direction has not yet been completed (NO at S23). If the processing for the x-direction is completed (YES in S23), the CPU11 may set the value of the unit embroidery region counter c to the number-of-unit embroidery regions (N) (S30). Then, the CPU11 may perform unit embroidery region modification processing for changing the size of the unit embroidery region set by the above processing, in accordance with a position and a size of the partial pattern in the region (S31). Following the above processing, the CPU11 may return to the main routine. Details of the unit embroidery region modification processing will be described later with reference to FIG. 7.

By performing the unit embroidery region setting processing steps of S20-S30, the initial unit embroidery regions may be set respectively as follows. For example, from the image data 100 of FIG. 8, a rectangle may be first obtained, which has a lower left point (x1, y1) and an upper right point (x2, y2). With this, the coordinates, x3, x4, y3, and y4, may be calculated based on the following equations (7)-(10):

$$x3 = x1 + \frac{(x2 - x1 - w)}{2}; \tag{7}$$

$$x4 = x1 + \frac{(x2 - x1 - w)}{2} + w; \tag{8}$$

$$y3 = y1 + \frac{(y2 - y1 - h)}{2}; \text{ and} \tag{9}$$

$$y3 = y1 + \frac{(y2 - y1 - h)}{2} + h. \tag{10}$$

Figure 9:
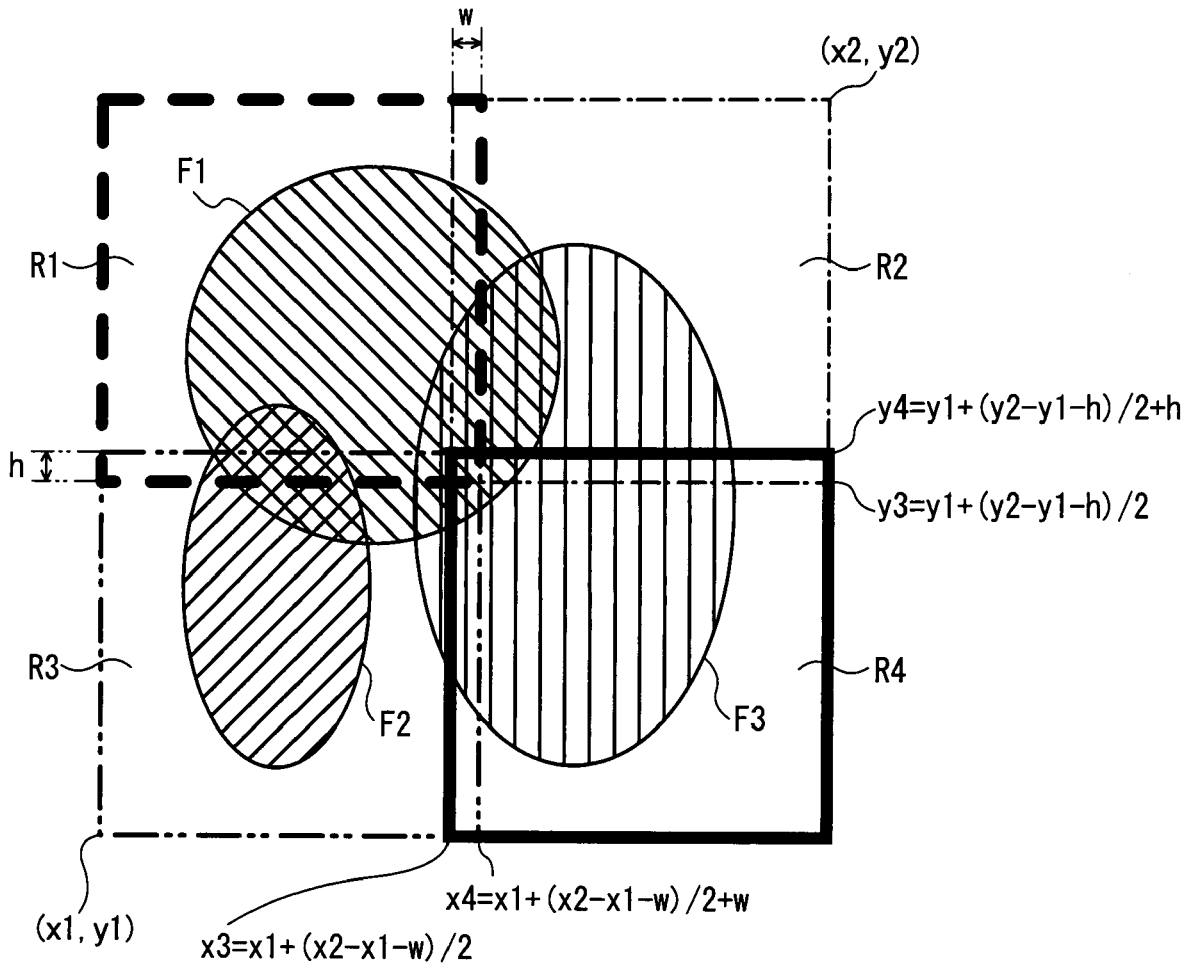
FIG. 9 is an explanatory illustration of unit embroidery regions that have been set.

Based on these coordinates, the following four rectangles of the unit embroidery regions, R1-R4, may be created as shown in FIG. 9 and stored in the unit embroidery region storage area 134:

Rectangle R1 (lower left point (x1, y3), upper right point (x4, y2));

Rectangle R2 (lower left point (x3, y3), upper right point (x2, y2));

Rectangle R3 (lower left point (x1, y1), upper right point (x4, y4)); and

Rectangle R4 (lower left point (x3, y1), upper right point (x2, y4)).

For example, when regional patterns are obtained in the set unit embroidery regions R1-R4 (S15 of FIG. 5), parts of the respective partial patterns F1, F2, and F3 are obtained from the unit embroidery region R1 and stored into the regional pattern data storage area 132 as regional pattern data. Parts of the respective partial patterns F1 and F3 are obtained from the unit embroidery region R2 and stored into the regional pattern data storage area 132 as regional pattern data. Parts of the respective partial patterns F1, F2, and F3 are obtained from the unit embroidery region R3 and stored into the regional pattern data storage area 132 as regional pattern data. Parts of the respective partial patterns F1 and F3 are obtained from the unit embroidery region R4 and stored into the regional pattern data storage area 132 as regional pattern data (S16 of FIG. 5). That is, if the unit embroidery regions R1-R4 are used as they are initially set, the partial patterns F1, F2 and F3 will all be divided into regional patterns. To solve such a problem, the unit embroidery region modification processing, S31 (FIG. 7), may be performed.

Next, the unit embroidery region modification processing (S31), which is performed during the unit embroidery region setting processing (FIG. 6), will be described with reference to FIG. 7 and FIGS. 10 through 12. When the unit embroidery region modification processing is started, the CPU11 may first set a target region counter n to 1 (S41). Next, the CPU11 may determine whether a unit embroidery region (for example, the unit embroidery region R1 in the first-time processing) indicated by the counter n contains a partial pattern (S42). An embroidery region may have a partial pattern if the partial pattern is completely or partially contained within the region. If the embroidery region does not contain a partial pattern (NO in S42), embroidery sewing may not be performed in that unit embroidery region. Therefore, there may be no need to modify the size of that particular region, so that the CPU11 may proceed directly to S54, to perform the processing for the next unit embroidery region.

If the unit embroidery region contains one or more partial patterns (YES at S42), the CPU11 may set the number of these partial patterns as FN (S43). For example, in an example shown in FIG. 9, the unit embroidery region R1 contains three partial patterns of F1, F2, and F3, so that FN is set to 3. Next, the respective partial patterns (RF[fn]) may be stored into the corresponding storage areas of the partial pattern storage area 140 in the RAM13 (S44). For example, in the example of FIG. 9, the partial patterns F1, F2, and F3 are stored into RF[1], RF[2], and RF[3], respectively, in the storage area that corresponds to the unit embroidery region R1 of the partial pattern storage area 140. These partial patterns may then undergo the processing sequentially as follows.

First, the CPU11 may set a target partial pattern fn to 1 (S45). The CPU11 may then determine whether this partial pattern RF[fn] (for example, RF[1], i.e., the partial pattern F1 in the first-time processing) protrudes from the unit embroidery region Rn in the vertical (height) direction (S46). If the partial pattern RF[fn] protrudes in the vertical direction (YES in S46), the CPU11 may determine whether a height of the unit embroidery region Rn exceeds the maximum sewing height H stored in the maximum sewing height storage area 137, if the height of Rn is expanded so as to completely contain that partial pattern (S47). If the expanded height of Rn is not larger than the maximum height H (NO in S47), the CPU11 may expand the height of the unit embroidery region Rn that is currently being processed until the partial pattern RF[fn] currently being processed is just completely contained within Rn (S48).

If the partial pattern RF[fn] does not protrude from the unit embroidery region Rn in the vertical direction (NO in S46), or if the maximum sewing height H is exceeded by the height of the unit embroidery region Rn that is expanded so as to completely contain the partial pattern RF[fn] completely (YES in S47), the CPU11 may not expand the height of the unit embroidery region Rn. Then, the CPU11 may determine whether the partial pattern RF[fn] protrudes from the unit embroidery region Rn in the horizontal (width) direction (S49). If the partial pattern RF[fn] protrudes in the horizontal direction (YES in S49), the CPU11 may determine whether a width of the unit embroidery region Rn exceeds the maximum sewing width W stored in the maximum sewing width storage area 136, if the width of the unit embroidery region Rn is expanded so as to completely contain the partial pattern RF[fn] (S50). If the expanded width of the embroidery unit region Rn is not larger than the maximum width W (NO in S50), the CPU11 may expand the width of the unit embroidery region Rn that is currently being processed until the partial pattern RF[fn] currently being processed is completely contained within that embroidery region Rn (S51).

If the partial pattern RF[fn] does not protrude from the unit embroidery region Rn in the horizontal direction (NO in S49), or if the maximum sewing width W is exceeded by the width of the unit embroidery region Rn that is expanded so as to completely contain the partial pattern (YES in S50), the CPU11 may not expand the width of the unit embroidery region Rn. Then, the CPU11 may proceed directly to S52, to perform the processing for the next partial pattern.

As described above, the unit embroidery region may have been expanded to contain one partial pattern as a target partial pattern, and the CPU11 may add 1 to a value of the target partial pattern fn (S52). Then, the CPU11 may determine whether the value of the target partial pattern fn is larger than a value of the number-of-partial patterns FN in the unit embroidery region (S53). If the value is not larger than the value FN (NO in S53), the CPU11 may return to S46 to expand the unit embroidery region Rn to a size appropriate for the remaining partial patterns. In the second-time processing and any subsequent processing, if any one of the unit embroidery regions is already expanded, the CPU11 may determine whether the target partial pattern protrudes from that expanded unit embroidery region.

In such a manner, if the partial pattern protrudes from the unit embroidery region in the vertical direction or in the horizontal direction, the unit embroidery region may be expanded to such an extent as not to exceed the maximum sewing height H or the maximum sewing width W, respectively.

Figure 10:
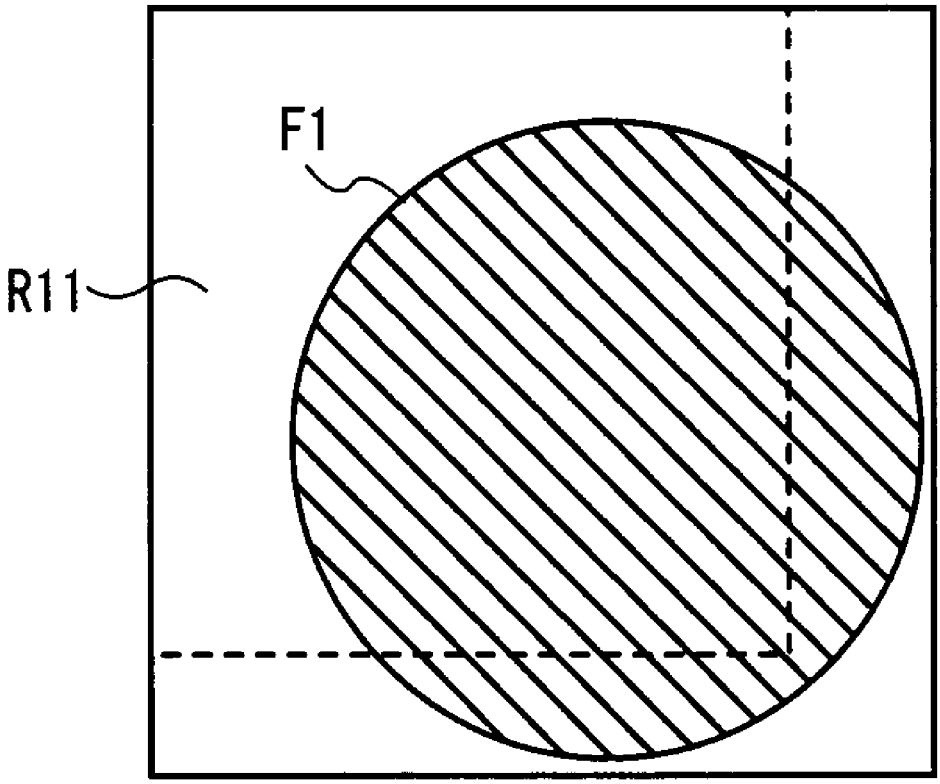
FIG. 10 is an explanatory illustration of a unit embroidery region after modification.

In the example of FIG. 9, the three partial patterns F1, F2, and F3 are partially contained within the unit embroidery region R1. Accordingly, the CPU11 first determines whether the partial pattern F1 protrudes from the unit embroidery region R1 (S46, S49) and then expands it both in the height direction (S48) and in the width direction (S51) to change it into a modified unit embroidery region R11 (FIG. 10). Next, the CPU11 determines whether the partial pattern F2 protrudes from the modified unit embroidery region R11 (S46, S49). In this example, if the modified unit embroidery region R11 is expanded in the height directions so as to completely contain the partial pattern F2, the maximum sewing length H is exceeded (YES in S47). Therefore, the CPU11 does not expand the modified unit embroidery region R11 in the height direction. Besides, because the partial pattern F2 does not protrude from the modified unit embroidery region R11 in the width direction (NO in S49), the CPU11 does not expand the modified unit embroidery region R11. The CPU11 also determines whether the partial pattern F3 protrudes from the modified unit embroidery region R11 (S46, S49). In this example, if the modified unit embroidery region R11 is expanded in the height direction so as to completely contain the partial pattern F3, the maximum sewing height H is exceeded (YES in S47) and the maximum sewing width W is also exceeded (YES in S50). Therefore, the CPU11 does not change the modified unit embroidery region R11.

If the value of fn exceeds the value of the number-of-partial patterns FN contained within the unit embroidery region (YES in S53), the CPU11 may determine that the modification processing has been completed for this unit embroidery region and so adds 1 to the target region counter n (S54). Then, the CPU11 may determine whether a value of n is larger than the number-of-unit embroidery regions N set in S30 of FIG. 6, that is, whether modification processing has been completed for all of the unit embroidery regions (S55). Then, if it is determined that the modification processing is not completed (NO in S55), the CPU11 may return to S42 to perform the modification processing on the next unit embroidery region. If the modification processing is completed for all of the unit embroidery regions (YES in S55), the CPU11 may end the unit embroidery region modification processing, and return to the unit embroidery region setting processing (FIG. 6).

Figure 11:
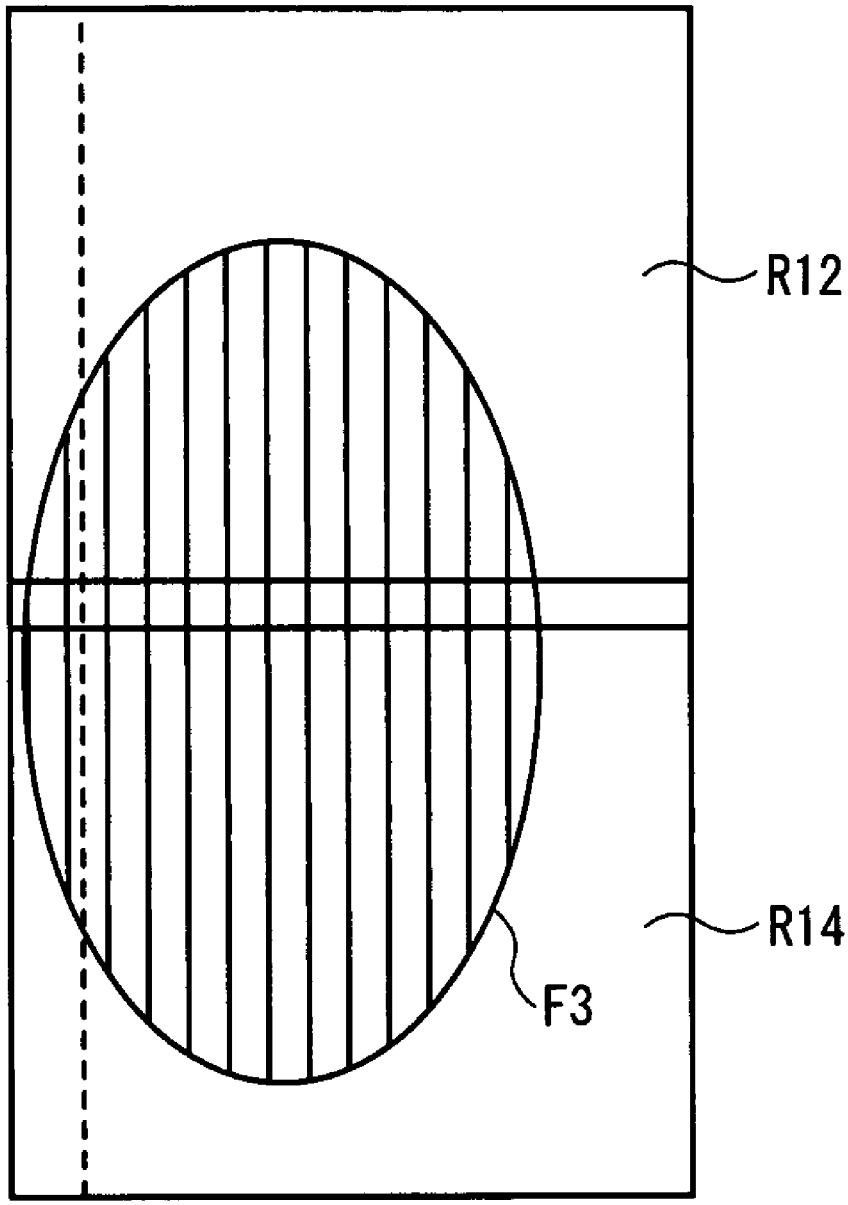
FIG. 11 is an explanatory illustration of another unit embroidery region after modification.
Figure 12:
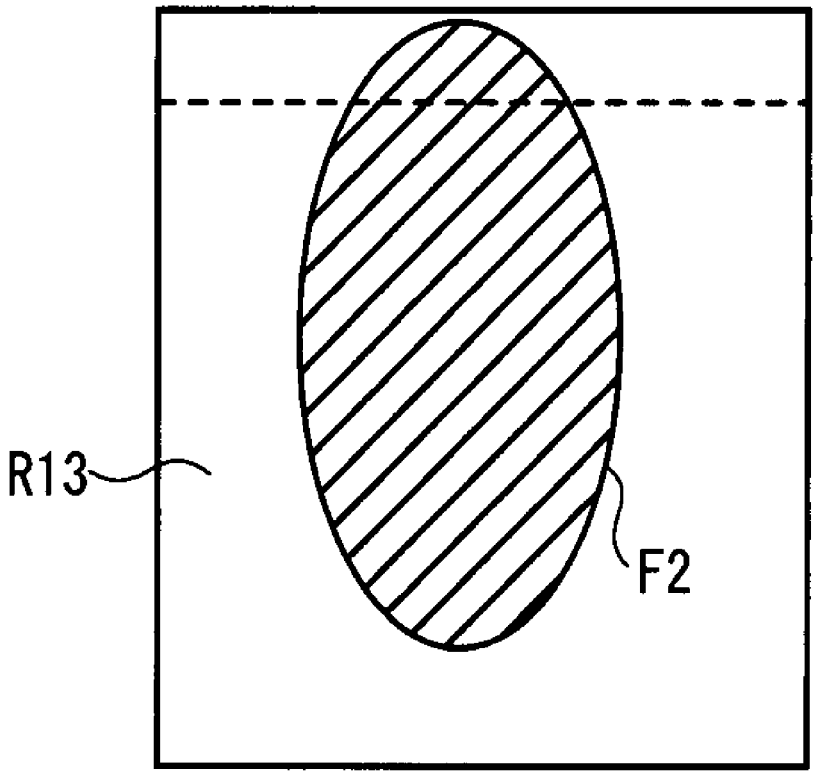
FIG. 12 is an explanatory illustration of a further unit embroidery region after modification.

Through the above processing, the unit embroidery regions R1 through R4 set as shown in FIG. 9, for example, have been changed into the modified unit embroidery regions R11 through R14 shown in FIGS. 10 through 12. Specifically, the region R1 has been changed by the above-described processing into the modified unit embroidery region R11 that completely contains the partial pattern F1. Accordingly, the partial pattern F1 can be sewn as one embroidery without being divided into several regional patterns.

Figure 7:
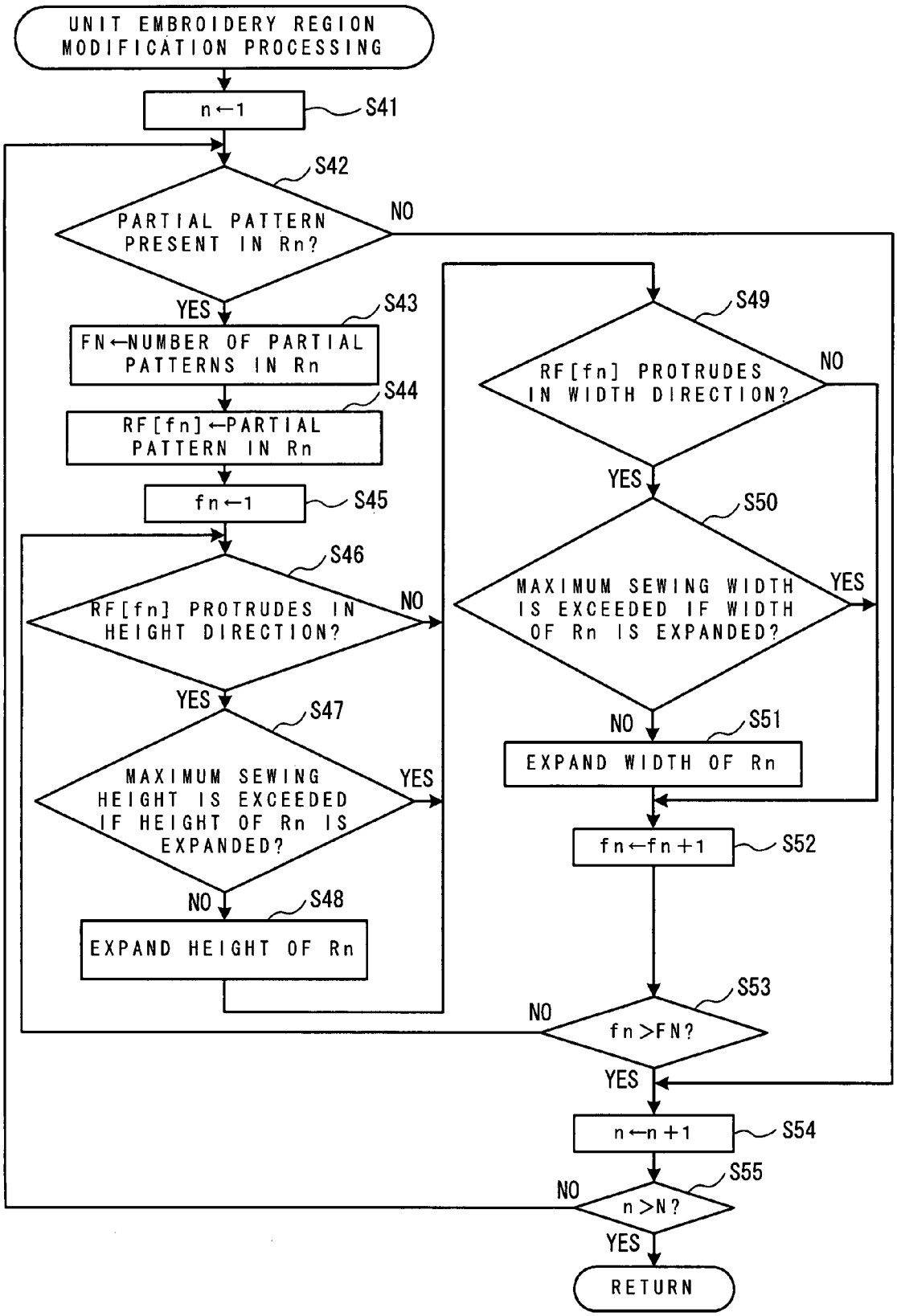
FIG. 7 is a flowchart of unit embroidery region modification processing that is performed during the unit embroidery region setting processing.
Figure 8:
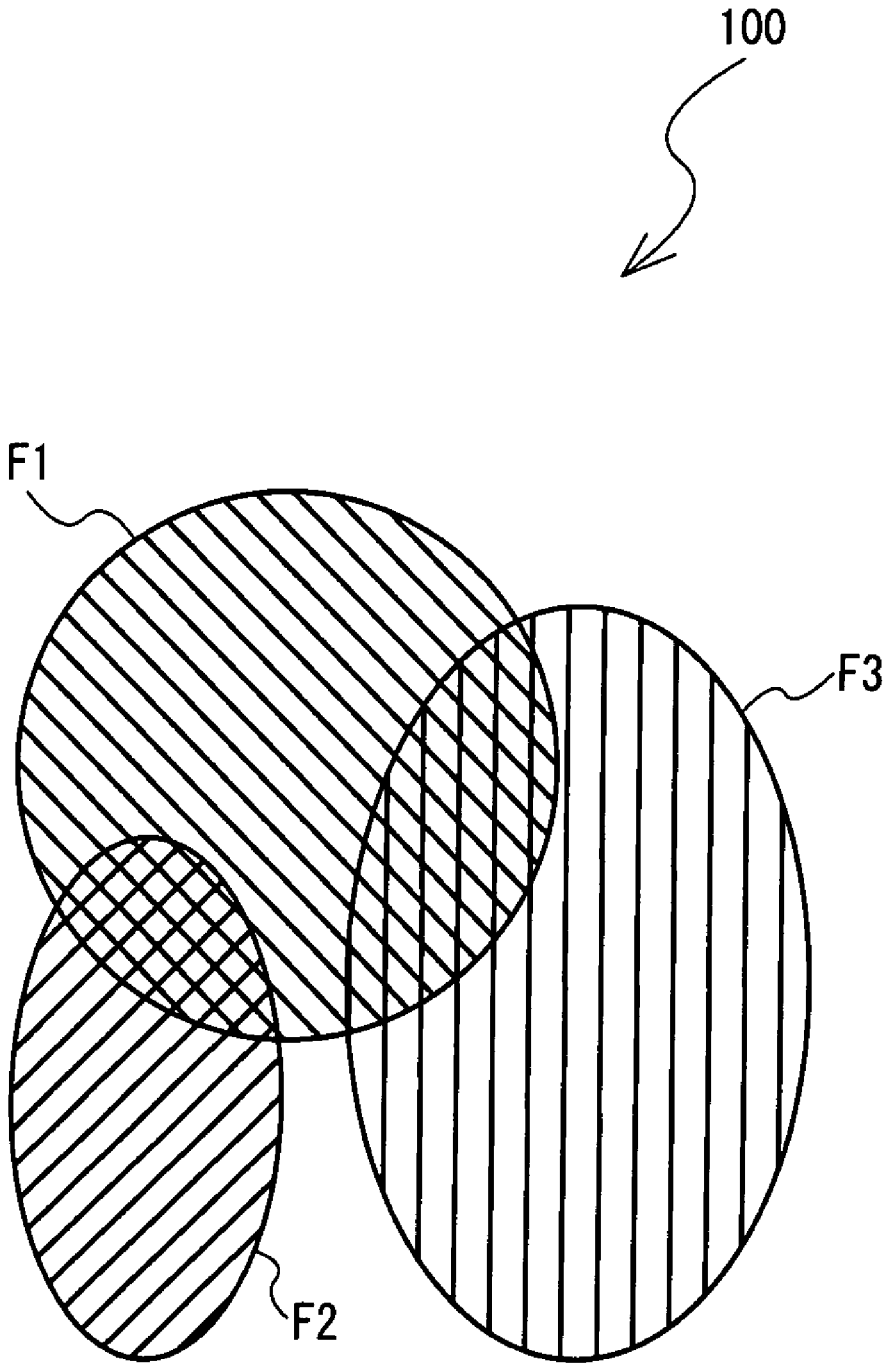
FIG. 8 is an explanatory illustration of an example of image data.

Further, the unit embroidery region R2 partially contains the partial patterns F1 and F3 (YES at S42 in FIG. 7). Even if the partial pattern F1 protrudes from the unit embroidery region R2 in the height direction (YES at S46), the height of the unit embroidery region R2 is not expanded, as the maximum sewing height H is exceeded if the unit embroidery region R2 is expanded to completely contain the partial pattern F1 (YES in S47). Also, the partial pattern F1 protrudes from the unit embroidery region R2 in the width direction (YES in S49). The maximum sewing width W, however, is exceeded if the unit embroidery region R2 is expanded in the width direction (YES in S50). Accordingly, the unit embroidery region R2 is not changed for the partial pattern F1. Further, although the partial pattern F3 protrudes from the unit embroidery region R2 in the height direction (YES in S46), the unit embroidery region R2 is not expanded, as the maximum sewing height H is exceeded if the unit embroidery region R2 is expanded in the height direction (YES at S47). On the other hand, the partial pattern F3 protrudes from the unit embroidery region R2 in the width direction (YES in S49), and the maximum sewing width W is not exceeded even if the unit embroidery region R2 is expanded in the width direction (NO in S50). Therefore, the unit embroidery region R2 is expanded in the width direction so as to completely contain the partial pattern F3 in the width direction, thus providing a modified unit embroidery region R12 as shown in FIG. 11 (S51). As a result, in the modified unit embroidery region R12, data is created of such a regional pattern that covers the partial pattern F3 in the width direction but divides the partial pattern F3 approximately by half in the height direction (S15 in FIG. 5).

Further, the unit embroidery region R3 partially contains the partial patterns F1, F2, and F3 (YES in S42). Although the partial pattern F1 protrudes from the unit embroidery region R3 in the height direction (YES in S46), the height of the unit embroidery region R3 is not expanded, because the maximum sewing height H is exceeded if the region R3 is expanded in the height direction (YES at S47). Also, the partial pattern F1 protrudes from the unit embroidery region R3 in the width direction (YES at S49). The maximum sewing width W, however, is exceeded if the unit embroidery region R3 is expanded in the width direction (YES in S50). Accordingly, the unit embroidery region R3 is not modified for the partial pattern F1. Further, the partial pattern F2 protrudes from the unit embroidery region R3 in the height direction (YES in S46). Even if the unit embroidery region R3 is expanded in the height direction so as to completely contain the partial pattern F2, the maximum sewing height H is not exceeded (NO in S47). Accordingly, as shown in FIG. 12, the unit embroidery region R3 is expanded in the height direction so as to completely contain the partial pattern F2 within the height direction (S48). Because the partial pattern F2 does not protrude from the unit embroidery region R3 in the width direction (NO in S49), the unit embroidery region R3 is not changed in the width direction, thus providing a modified unit embroidery region R13. Further, although the partial pattern F3 protrudes from the modified unit embroidery region R13 in the height direction (YES in 46), the modified unit embroidery region R13 is not expanded, because the maximum sewing height H is exceeded if the modified unit embroidery region R13 is expanded in the height direction (YES in S47). The partial pattern F3 also protrudes in the width direction (YES at S49). The maximum sewing width W, however, is exceeded if the region R13 is expanded in the width direction (YES at S50). Accordingly, the modified unit embroidery region R13 is not further changed. As a result, the regional pattern data of F2 is obtained from the whole partial pattern F2 that corresponds to the modified unit embroidery region R13 (S 15 in FIG. 5). Accordingly, the partial pattern F2 may be sewn as one embroidery without being divided into several regional patterns.

Further, because the partial pattern F1 is completely contained within the modified unit embroidery region R11, it is unnecessary to divide the partial pattern F1 by a boundary of the modified unit embroidery region R13 to create a part of it as data of a regional pattern corresponding to the modified unit embroidery region R13. Also, as approximately half of the partial pattern F3 is contained within the above-described modified unit embroidery region R12 and a later-described modified unit embroidery region R14, it is also unnecessary to create part of the partial pattern F3 as data of a regional pattern corresponding to the modified unit embroidery region R13.

Further, the unit embroidery region R4 partially contains the partial patterns F1 and F3 (YES in S42). Because the partial pattern F1 from the unit embroidery region R4 in the height direction (YES at S46), and the maximum sewing height H is exceeded if the unit embroidery region R4 is expanded (YES in S47), the unit embroidery region R4 is not expanded in the height direction. Also, the partial pattern F1 protrudes from the unit embroidery region R4 in the width direction (YES in S49), but the maximum sewing width W is exceeded if the unit embroidery region R4 is expanded (YES at S50). Accordingly, the unit embroidery region R4 is not changed for the partial pattern F1. Further, because the partial pattern F3 protrudes from the unit embroidery region R4 in the height direction (YES at S46), and the maximum sewing height H is exceeded if the unit embroidery region R4 is expanded (YES in S47), the unit embroidery region R4 is not expanded in the height direction. The partial pattern F3 also protrudes from the unit embroidery region R4 in the width direction (YES in S49). Even if the unit embroidery region R4 is expanded in the width direction, the maximum sewing width W is not exceeded (NO in S50). Therefore, the unit embroidery region R4 is expanded in the width direction so as to completely contain the partial pattern F3 in the width direction, thus providing the modified unit embroidery region R14 as shown in FIG. 11 (S51). As a result, in the modified unit embroidery region R14, data is created of such a regional pattern that covers the partial pattern F3 in the width direction but divides the partial pattern F3 approximately by half in the height direction (S15 in FIG. 5).

Through the above processing, the data of the whole partial pattern F1 has been created as a regional pattern data corresponding to the modified unit embroidery region R11. Moreover, the data of approximately half of the partial pattern F3, the whole partial pattern F2, and approximately half of the partial pattern F3 has been created as the regional pattern data, respectively, corresponding to the modified unit embroidery regions R12, R13 and R14, as shown in FIGS. 10-12. Therefore, the number of regional patterns, which are created from the partial patterns divided by the boundaries of the unit embroidery regions, can be decreased, as compared to the cases of the above-described initial settings of the unit embroidery regions R1-R4. As a result, more partial patterns can be sewn as one embroidery, thereby improving a quality of the products.

According to the unit embroidery region setting and modification processing of the above-described first embodiment, a rectangle that completely contains a target embroidery pattern may be divided into identical rectangles to be set as unit embroidery regions, and then they may be expanded in the height and width direction in accordance with partial patterns contained within them.

However, the unit embroidery region setting and modification processing is not limited to the above-described first embodiment. A second embodiment for setting a maximum sewing region as a unit embroidery region is described. In the following second embodiment, a rectangle that completely contains a target embroidery pattern may be first divided into several rectangles. One point of the obtained rectangles may be employed as a base point to set a maximum sewing region as a unit embroidery region. The size of this region may then be reduced to match partial patterns contained within the region.

Figure 13:
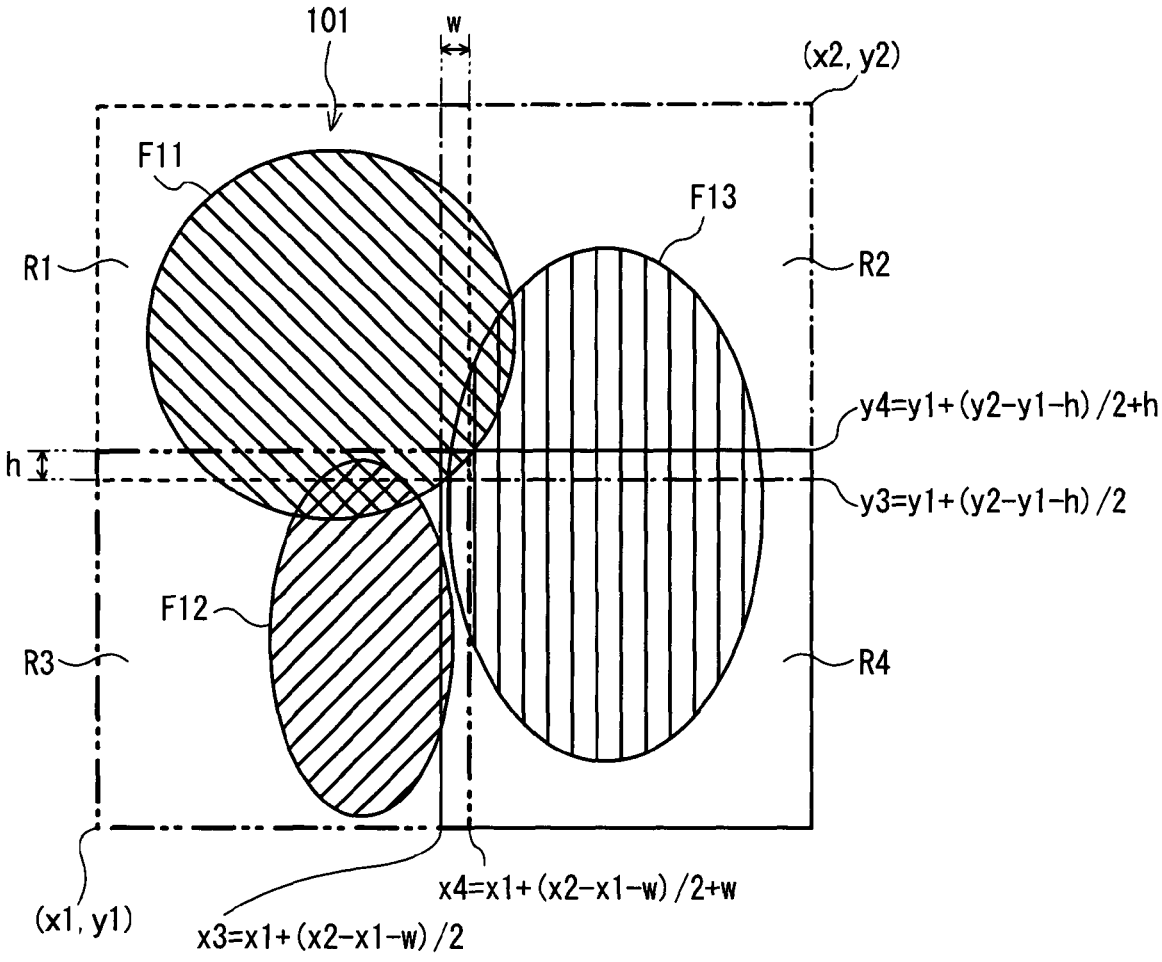
FIG. 13 is an explanatory illustration of a unit embroidery region that has been set in accordance with an exemplary embodiment.

A configuration, a main routine, and unit embroidery region setting processing for an embroidery data processing apparatus of the second embodiment may be the same as those of the first embodiment. Accordingly their explanation will be omitted, and only unit embroidery region modification processing, which is performed in S31 in FIG. 6, is described with reference to FIG. 13 through FIG. 18. As shown in FIG. 13, partial patterns F11, F12, and F13 that compose image data 101 to be used in the present embodiment may have the same shapes as the partial patterns F1, F2, and F3 of the first embodiment, respectively, but they may overlap with each other at different positions. Further, as the image data 101, the same unit embroidery regions R1 through R4 as those set in the first embodiment may be initially set beforehand by the unit embroidery region setting processing described with the first embodiment.

Figure 14:
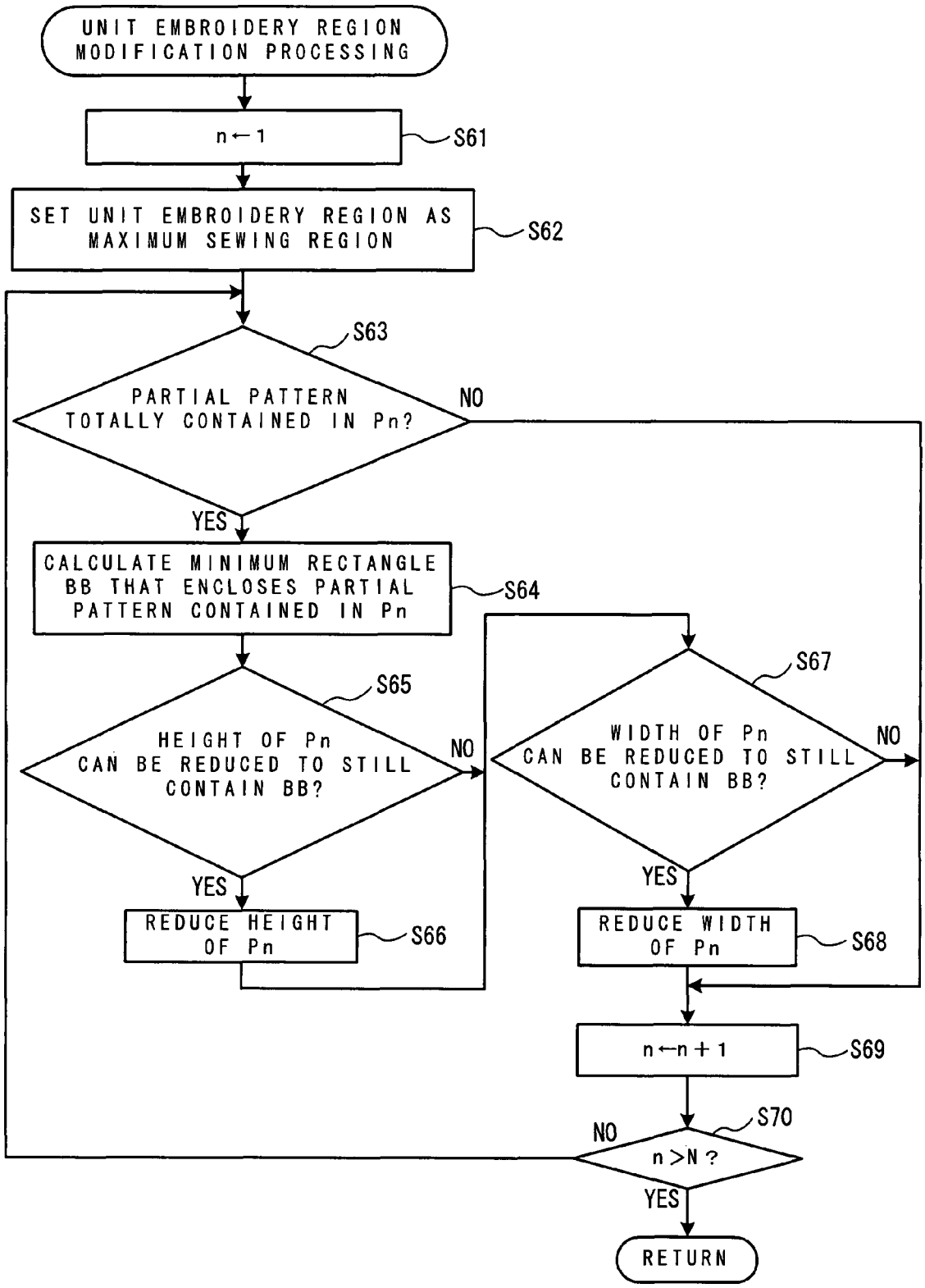
FIG. 14 is a flowchart of unit embroidery region modification processing in accordance with an exemplary embodiment.
Figure 15:
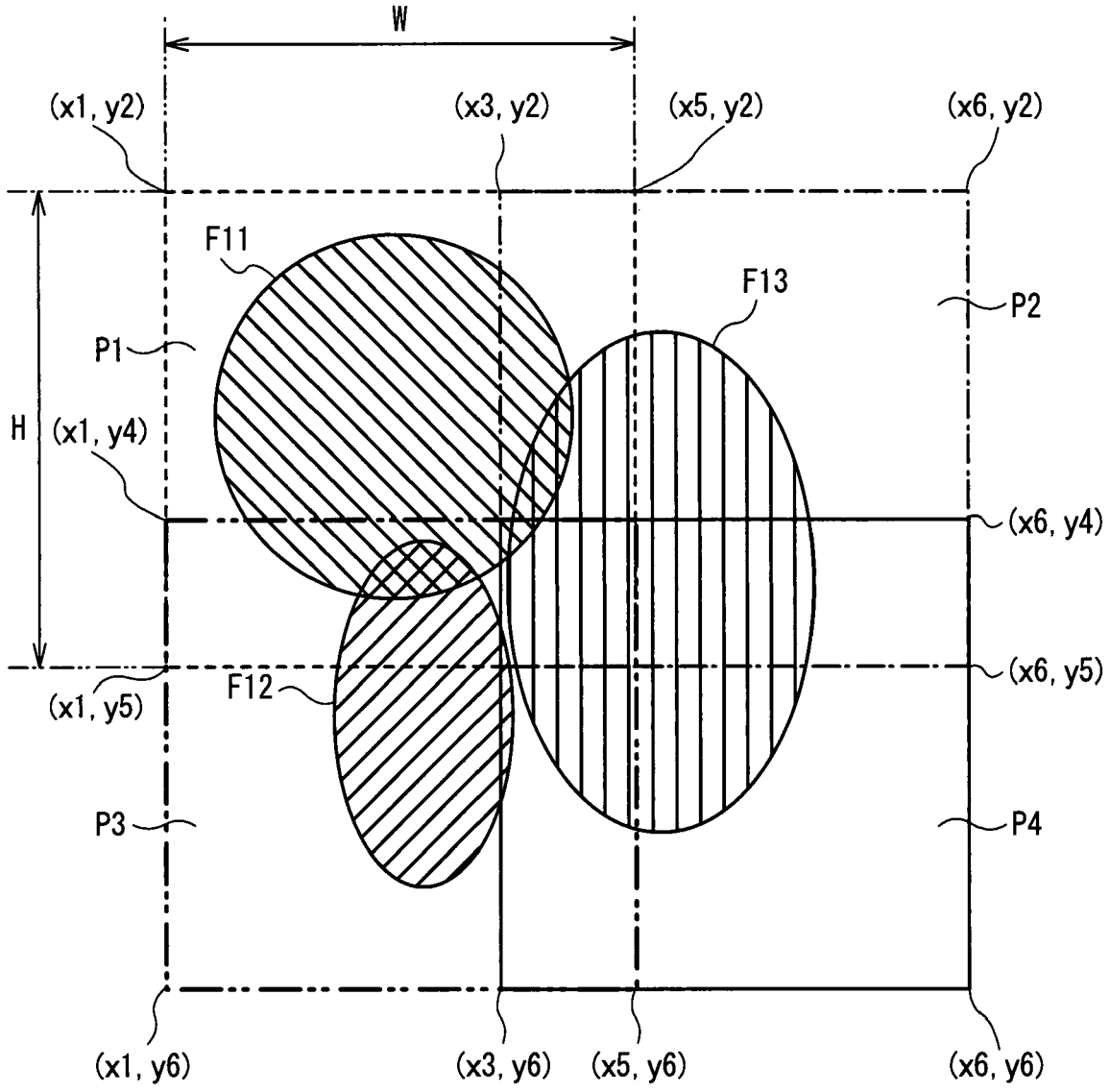
FIG. 15 is an explanatory illustration of unit embroidery regions with a maximum sewing size that have been set in accordance with an exemplary embodiment.

As shown in FIG. 14, when the unit embroidery region modification processing has been invoked, the CPU11 may first set a target region counter n to 1 (S61). Next, the CPU11 may set a unit embroidery region Pn with a maximum sewing size having a maximum sewing width W and a maximum sewing height H, for example, as shown in FIG. 15, by using an upper left point of the unit embroidery regions R1 through R4 (See FIG. 13) as a base point, which has been set in the processing shown in FIG. 6 (S62). Specifically, the following four unit embroidery regions may be set:

Unit embroidery region P1 (lower left point (x1, y5), upper right point (x5, y2));

Unit embroidery region P2 (lower left point (x3, y5), upper right point (x6, y2));

Unit embroidery region P3 (lower left point (x1, y6), upper right point (x5, y4)); and Unit embroidery region P4 (lower left point (x3, y6), upper right point (x6, y4)).

Next, the CPU11 may determine whether a unit embroidery region Pn, which is indicated by the counter (for example, the unit embroidery region P1 in the first-time processing), completely contains any of the partial patterns (S63). If none of the partial patterns is completely contained within the unit embroidery region Pn (NO in S63), the CPU11 may not modify the particular unit embroidery region Pn and may directly proceed to S69 to perform the processing for the next unit embroidery region.

If any of the partial patterns is contained in the unit embroidery region Pn (YES in S63), the CPU11 may calculate a minimum rectangle BB that encloses all of the partial patterns that are completely contained in the unit embroidery region Pn (S64). Then, it may determine whether a height of the unit embroidery region Pn may be reduced to such a height that the minimum rectangle BB may still be completely contained, using the upper left point of the unit embroidery region Pn as a base point (S65). If the height of the minimum rectangle BB is equal to that of the unit embroidery region Pn, the height of the unit embroidery region Pn may not further be reduced (NO in S65). Accordingly, the CPU11 may not reduce the height and may directly proceed to S67.

If the height of the unit embroidery region Pn may be reduced to such a height that the minimum rectangle BB may still be completely contained (YES in S65), the CPU11 may reduce the height of the unit embroidery region Pn to such a height that the minimum rectangle BB is just completely contained, using the upper left point of the unit embroidery region Pn as a base point (S66).

Figure 16:
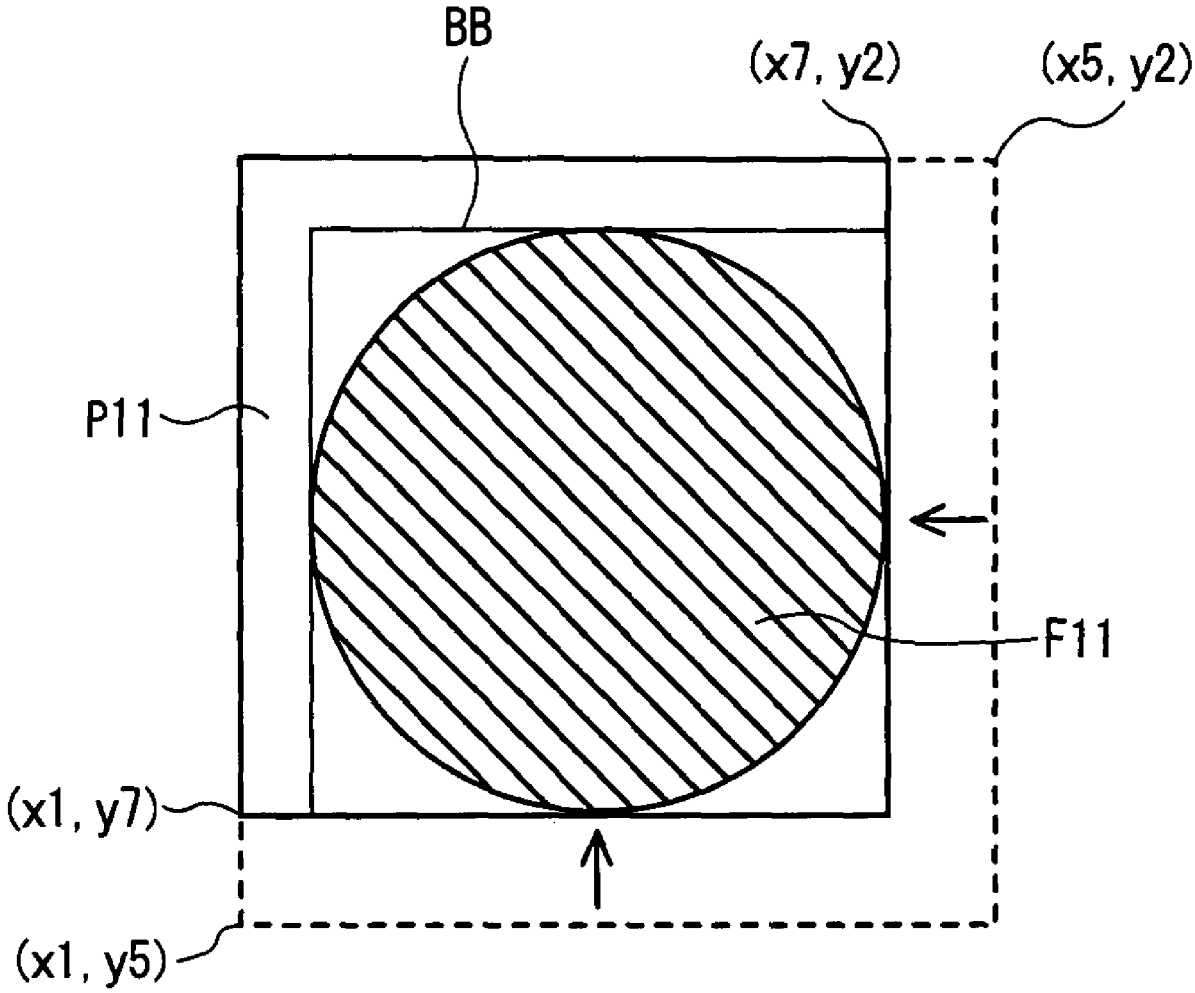
FIG. 16 is an explanatory illustration of a unit embroidery region after modification.

For example, as shown in FIG. 15, only the partial pattern F1 may be completely contained within the unit embroidery region P1 (YES at S63), and the minimum rectangle BB that encloses the partial pattern F11 is obtained (S64). As shown in FIG. 16, the height of the unit embroidery region P1 may be further reduced so that the minimum rectangle BB is still completely contained (YES in S65). Therefore, as shown in FIG. 16, the unit embroidery region P1 is reduced in the height direction, using the upper left point (x1, y2) as a base point, to provide a lower left point (x1, y7) (S66).

When the processing for the height direction is completed, the CPU11 may next determine whether a width of the relevant unit embroidery region Pn may be reduced to such a width that the minimum rectangle BB may still be completely contained, using the upper left point as the base point (S67). If a width of the minimum rectangle BB is equal to that of the unit embroidery region Pn, the width of the unit embroidery region may not be further reduced (NO in S67). Accordingly, the CPU11 may not reduce the width and may directly proceed to S69 to perform the processing for the next unit embroidery region.

If the width of the unit embroidery region Pn may be reduced to such a width that the minimum rectangle BB may still be completely contained (YES in S67), the CPU11 may reduce the width of the unit embroidery region Pn to such a width that the minimum rectangle BB is just completely contained (S68).

For example, the width of the unit embroidery region P1 may be further reduced if the minimum rectangle BB that encloses the partial pattern F1 is completely contained (YES in S67). Accordingly, as shown in FIG. 16, the unit embroidery region P1 is reduced in the width direction with the upper left point (x1, y2) as the base point, thus providing an upper right point (x7, y2) (S68).

Through the above processing, the unit embroidery region Pn may have been modified in such a manner that any of the partial patterns may be appropriately contained. In the example of FIG. 15, the unit embroidery region P1 is reduced both in the height and width directions into a modified unit embroidery region P11 having a lower left point (x1, y7) and an upper right point (x7, y2) as shown in FIG. 16.

Figure 6:
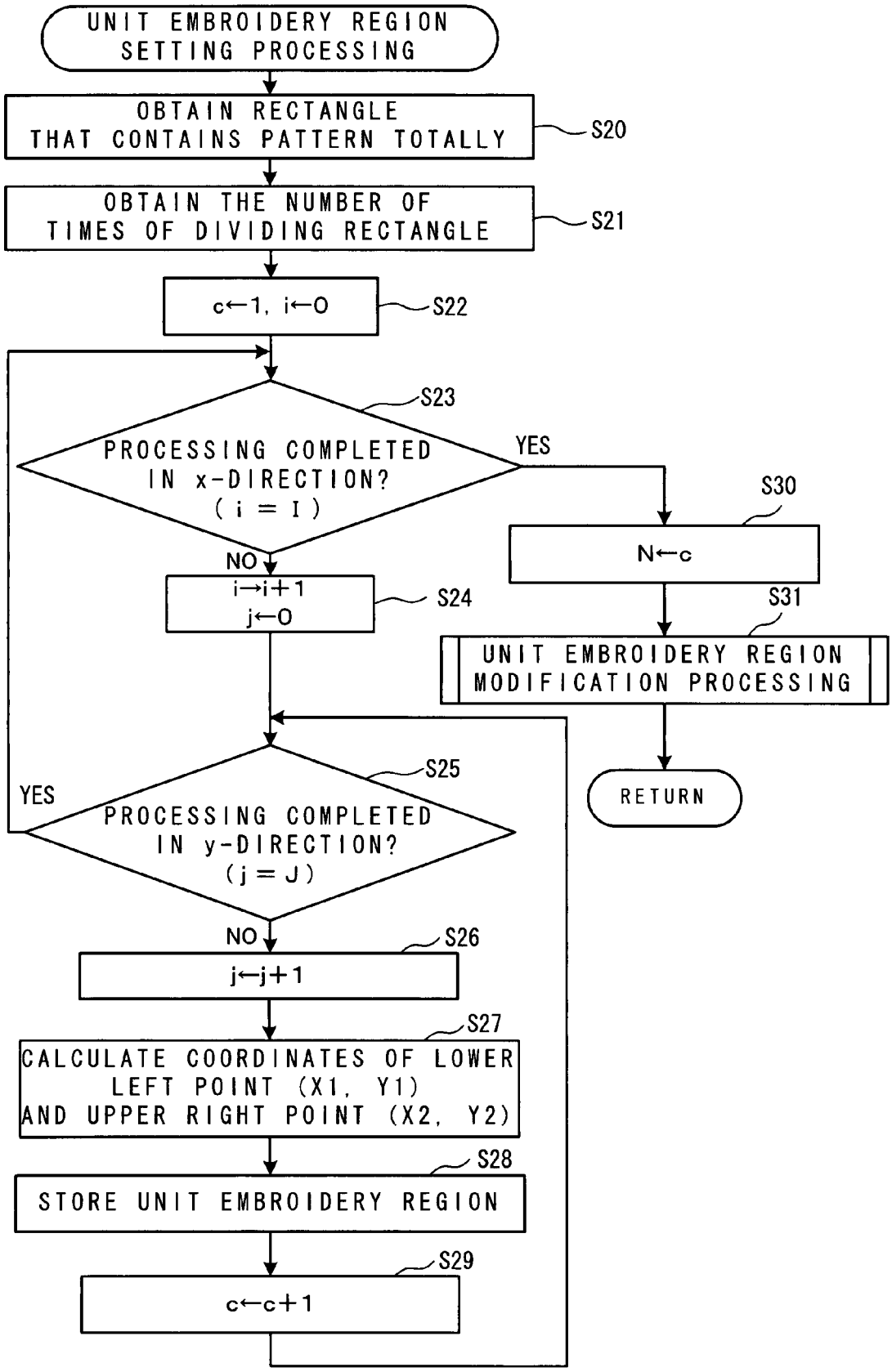
FIG. 6 is a flowchart of unit embroidery region setting processing that is performed during the embroidery data creation processing.

Next, the CPU11 may add 1 to the target region counter n (S69) and determine whether a value of n is larger than the number-of-unit embroidery regions N set in S30 in FIG. 6, that is, whether the processing for all of the unit embroidery regions Pn has been completed (S70). If the processing for all of the unit embroidery regions Pn is not completed (NO in S70), it may return to S63 to perform the downsizing processing for the next unit embroidery region. If the processing is completed for all of the unit embroidery regions Pn (YES in S70), it may end the unit embroidery region modification processing, to return to the unit embroidery region setting processing in FIG. 6.

Figure 17:
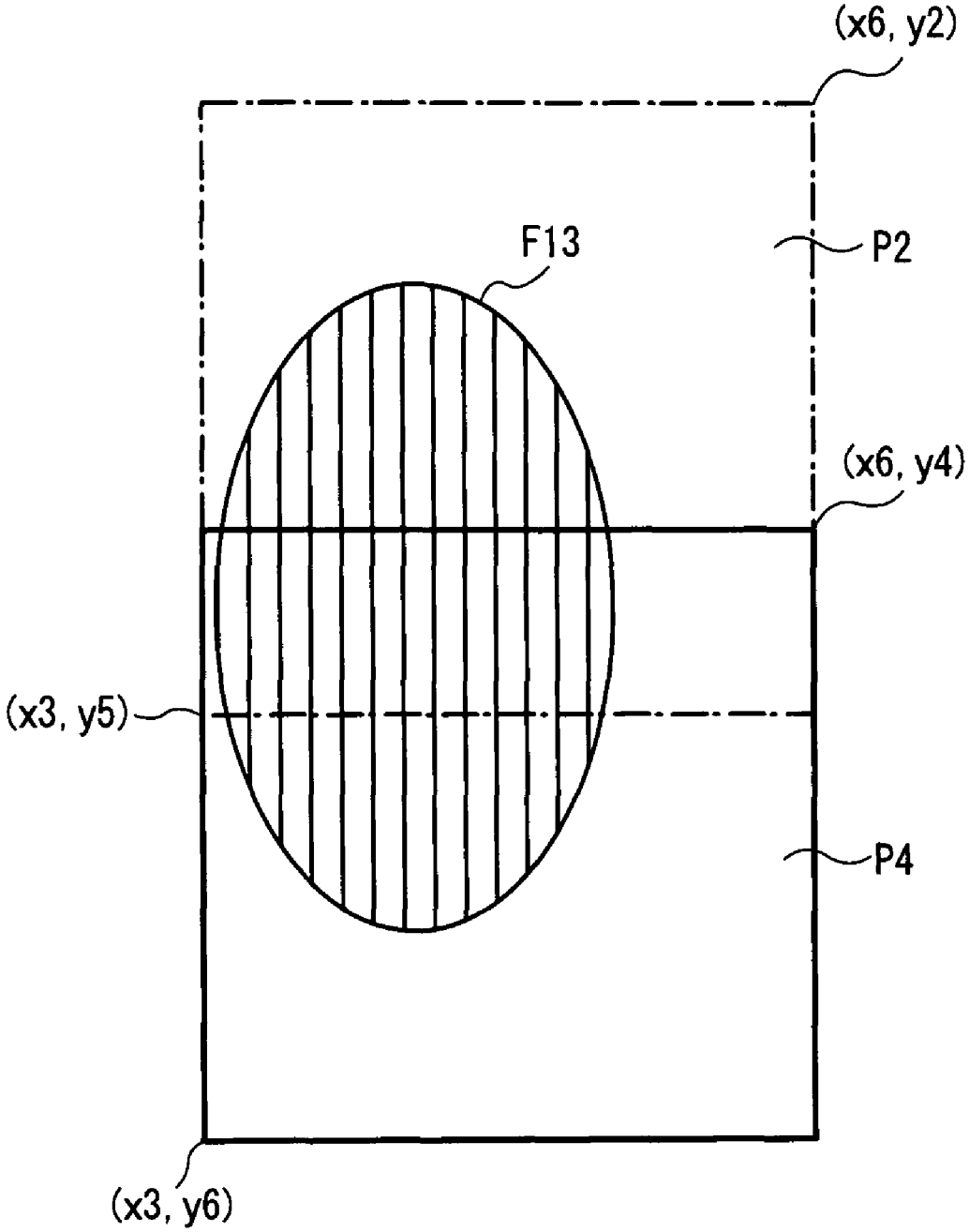
FIG. 17 is an explanatory illustration of another unit embroidery region after modification.
Figure 18:
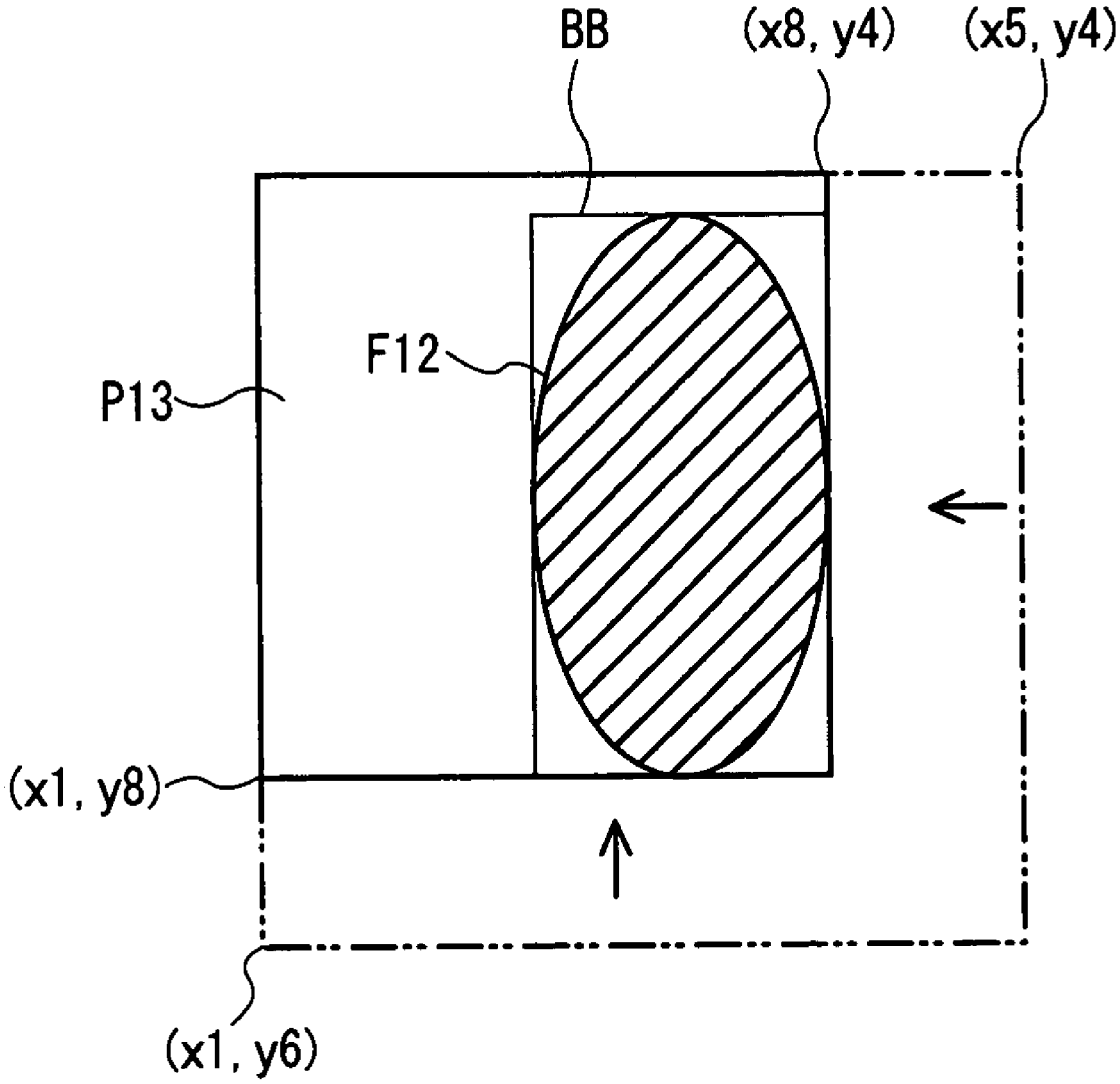
FIG. 18 is an explanatory illustration of a further unit embroidery region after modification.
Figure 19:
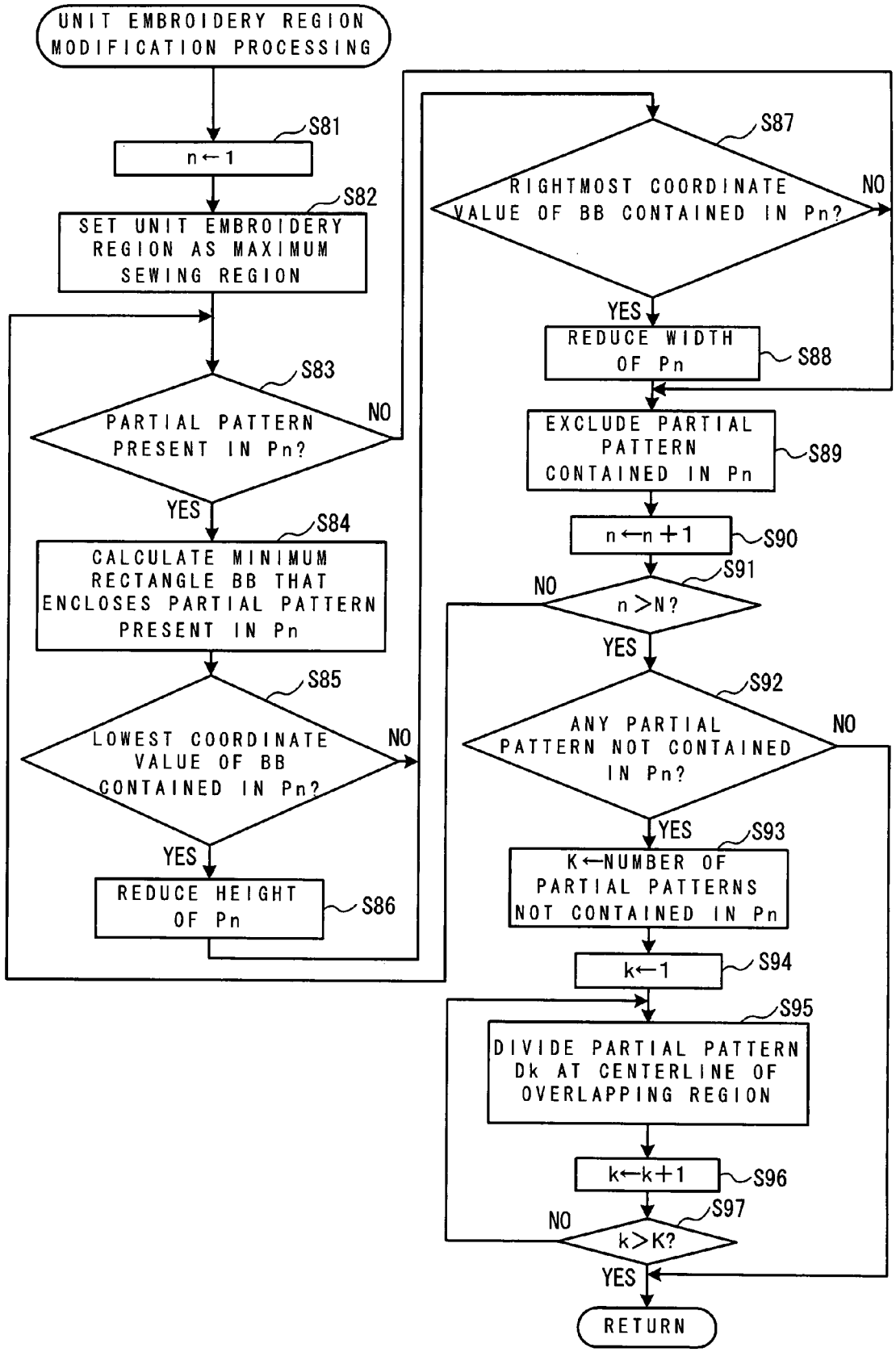
FIG. 19 is a flowchart of unit embroidery region modification processing in accordance with an exemplary embodiment.

According to the unit embroidery region setting processing of the second embodiment, in the example of FIG. 15, the unit embroidery region P1 having the maximum sewing size initially set is changed to the modified unit embroidery region P11 as described above and shown in FIG. 16. Further, because no partial pattern is completely contained within the unit embroidery region P2 (NO in S63), the unit embroidery region P2 remains unchanged. On the other hand, the unit embroidery region P3 contains the partial pattern F12 (YES in S63), so that a minimum rectangle BB that encloses the partial pattern F12 is calculated (S64). As shown in FIG. 18, the height of the unit embroidery region P3 may be further reduced so that the minimum rectangle BB is still completely contained (YES in S65). Therefore, the height of the unit embroidery region P3 is reduced using the upper left point (x1, y4) as a base point (S66). Furthermore, the width of the unit embroidery region P3 may be reduced so that that the minimum rectangle BB is still completely contained (YES in S67). Accordingly, as shown in FIG. 18, the unit embroidery region P3 is also reduced in the width direction using the upper left point (x1, y4) as a base point (S68). As a result, the unit embroidery region P3 is changed into the rectangular region P13 having a lower left point (x1, y8) and an upper right point (x8, y4) (S68). Further, similar to the unit embroidery region P2, as no partial pattern is completely contained within the unit embroidery region P4 (NO in S63), the unit embroidery region P4 remains unchanged as shown in FIG. 17. Therefore, regional pattern data of the whole partial pattern F11 is created in the modified unit embroidery region P11, the regional pattern data is created in the unit embroidery region P2 by dividing the partial pattern F13 by the boundary of the unit embroidery region P2, the regional pattern data of the whole partial pattern F12 is created in the rectangular region P13, and the regional pattern data is created in the unit embroidery region P4 by dividing the partial pattern F13 by the boundary of the unit embroidery region P4 (S15 in FIG. 5).

As described above, by setting a size of an initial unit embroidery region to a maximum sewing size determined by an embroidery frame and reducing it in such a manner so as to match sizes of partial patterns contained within the set unit embroidery region, the unit embroidery region may be made an appropriate size. As a result, the partial patterns may less likely to be divided to create several regional pattern data and so may be sewn as one embroidery, thereby improving a quality of the products.

In the second embodiment, the CPU11 may first determine whether there is any partial pattern completely enclosed in a unit embroidery region set to have a maximum sewing size. Alternatively, the CPU11 may determine whether a partial pattern, if not completely contained within a unit embroidery region, is contained within the height direction or within the width direction. If the partial pattern is not completely contained, the CPU11 may perform modification (downsizing) processing. The following will describe a third embodiment, which may be employed in such a case.

A configuration, a main routine, and unit embroidery region setting processing for an embroidery data processing apparatus of the third embodiment may be the same as those of the first embodiment and the second embodiment. Accordingly, their explanation will be omitted, and only unit embroidery region modification processing, which is performed in S31 in FIG. 6, will be described with reference to FIGS. 19 through 31.

Figure 20:
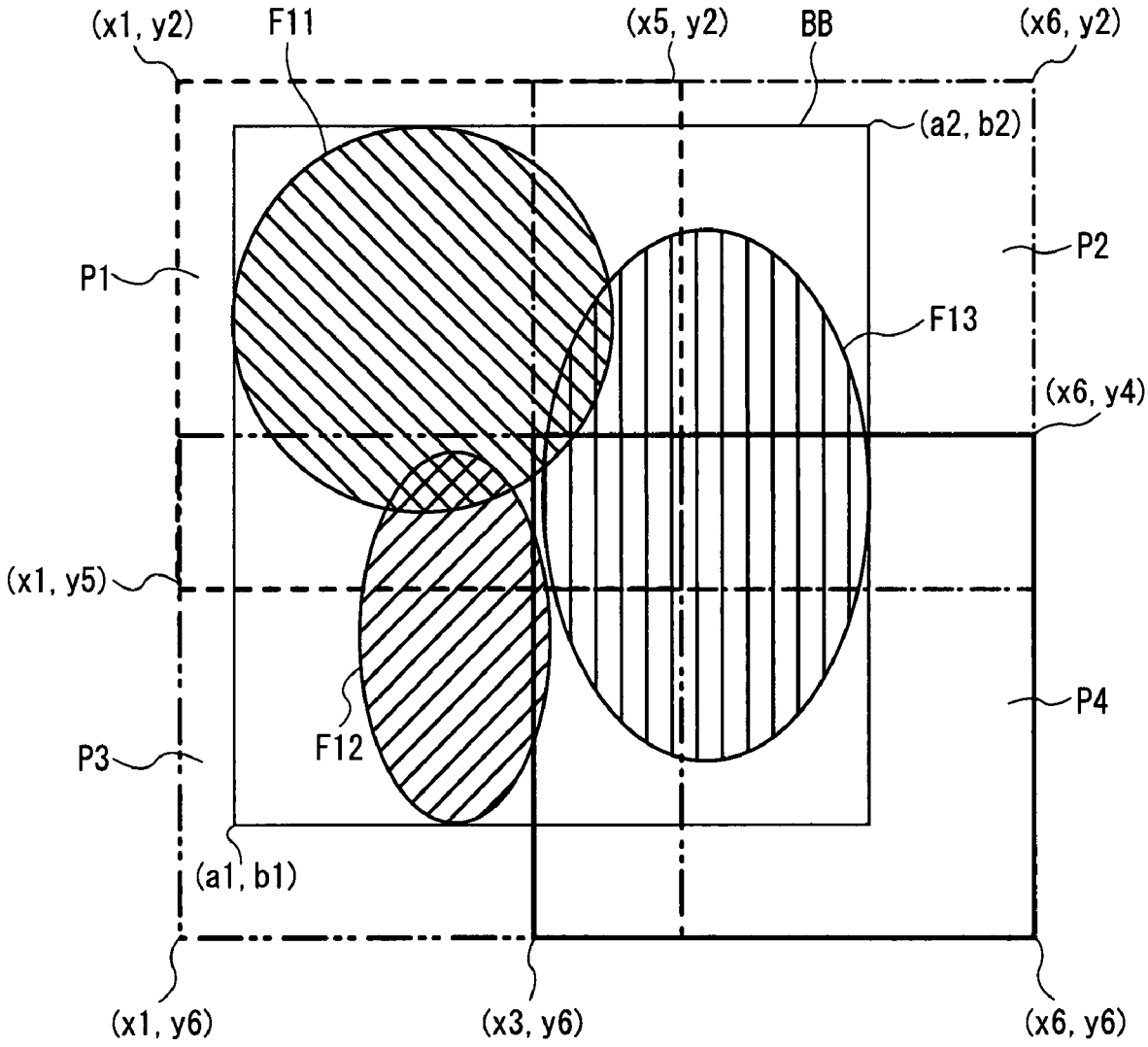
FIG. 20 is an explanatory illustration of unit embroidery regions with a maximum sewing size that have been set in accordance with an exemplary embodiment.
Figure 21:
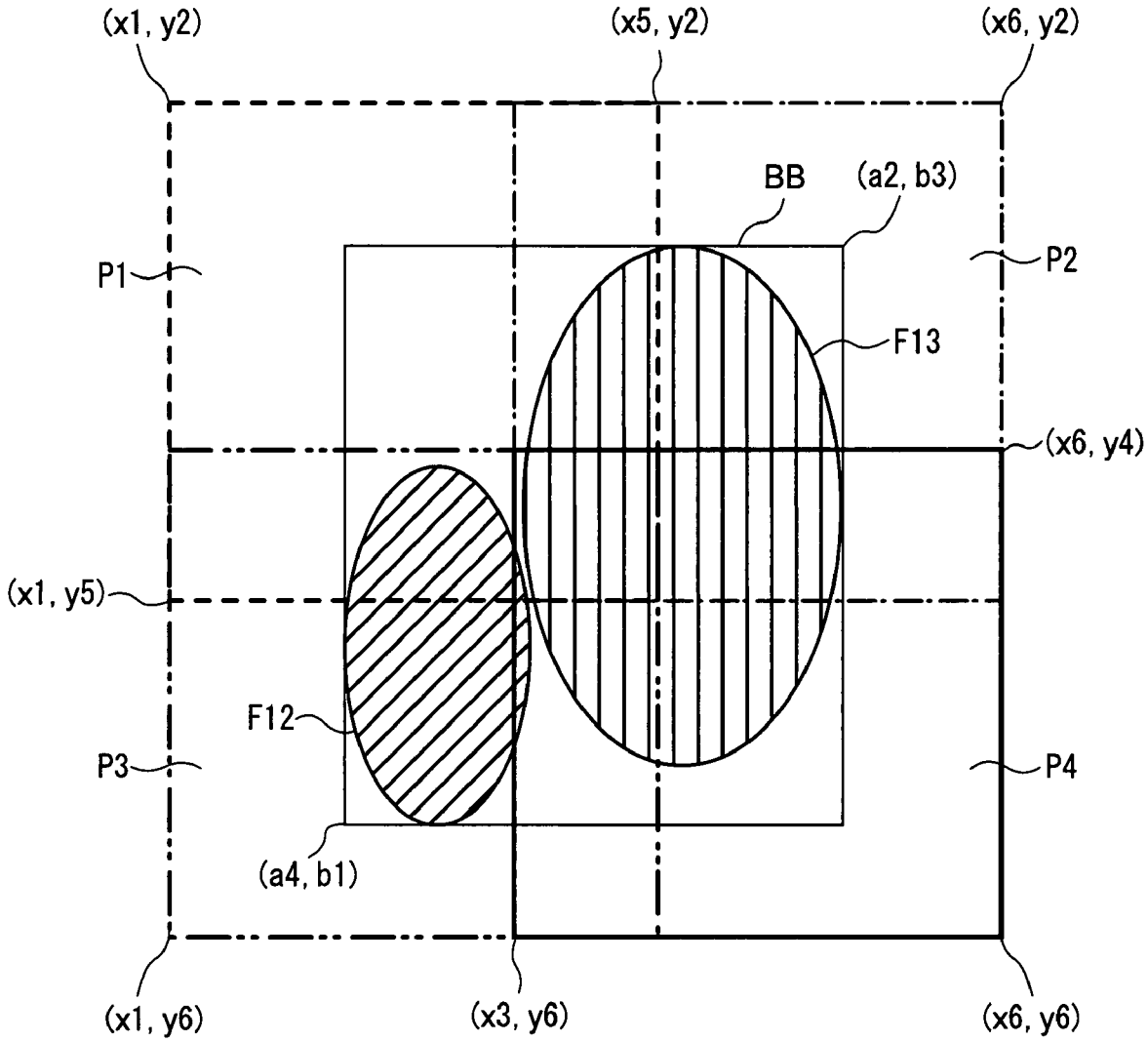
FIG. 21 is an explanatory illustration of a modification of the unit embroidery regions.

When the unit embroidery region modification processing is invoked, first a CPU11 may set a target region counter n to 1 (S81). Next, as in the case of the second embodiment, for the image data 101, the CPU11 may set unit embroidery regions, each having a maximum sewing size with a maximum sewing width W and a maximum sewing height H. For example, as shown in FIG. 20, using as a base point an upper left point of the unit embroidery regions R1 through R4 (see FIG. 13), which have been set in the processing shown in FIG. 6 (S82). That is, the following four unit embroidery regions may be set:

Unit embroidery region P1 (lower left point (x1, y5), upper right point (x5, y2));

Unit embroidery region P2 (lower left point (x3, y5), upper right point (x6, y2));

Unit embroidery region P3 (lower left point (x1, y6), upper right point (x5, y4)); and Unit embroidery region P4 (lower left point (x3, y6), upper right point (x6, y4)).

Next, the CPU11 may determine whether a unit embroidery region Pn, which is indicated by the counter (region P1 in first-time processing), contains any part of the partial patterns (S83). If no part of any of the partial patterns is contained within the unit embroidery region Pn (NO in S83), the CPU11 may not modify the unit embroidery region Pn and may directly proceed to S89.

If any part of the partial patterns is contained within the unit embroidery region Pn (YES in S83), the CPU11 may calculate a minimum rectangle BB that encloses all of the partial patterns that are at least partially contained within the unit embroidery region Pn (S84). In an example shown in FIG. 20, the minimum rectangle BB has a lower left point (a1, b1) and an upper right point (a2, b2) and is drawn so as to enclose the partial patterns F11, F12, and F13. With this, the CPU11 may determine whether the lowest coordinate value (b1 in the example of FIG. 20) of that minimum rectangle BB is vertically contained within the unit embroidery region Pn (in the height direction) (S85). If the lowest coordinate value is not contained within the height direction (NO in S85), the CPU11 may not reduce the height of the unit embroidery region Pn and may proceed directly to S87. For example, during the first-time processing, the minimum rectangle BB is set as shown in FIG. 20 and its lowest coordinate value b1 is not contained within the unit embroidery region P1 in the height direction, so that the unit embroidery region P1 is not reduced in the height direction.

However, if the lowest coordinate value of the minimum rectangle BB is contained within the unit embroidery region Pn in the height direction (YES in S85), the CPU11 may reduce the height of the unit embroidery region Pn to such a lowest height that the lowest coordinate value is still contained, using an upper left point of Pn as a base point (S86).

Next, the CPU11 may determine whether a rightmost coordinate value of the minimum rectangle BB (a2 in the example of FIG. 20) is contained within a width of the unit embroidery region Pn, that is, whether it is contained within the width direction (S87). If the rightmost coordinate value of the minimum rectangle BB is not contained within the unit embroidery region Pn (NO in S87), the CPU11 may not reduce the width of the unit embroidery region Pn and may directly proceed to S89. For example, during the first-time processing, the rightmost coordinate value a2 of the rectangle BB may not be contained within the unit embroidery region P1 in the width direction, so that the CPU11 does not perform the downsizing processing for the width direction. Therefore, the unit embroidery region P1 is not modified.

If the rightmost coordinate value of the minimum rectangle BB is contained within the unit embroidery region Pn in its width direction (YES in S87), the CPU11 may reduce its width to such a minimum value that the rightmost coordinate value of the minimum rectangle BB is still completely contained, using the upper left point of the unit embroidery region Pn as the base point (S88).

The above processing steps, S83 through S88, may have completed the modification processing for one unit embroidery region Pn so that the CPU11 may exclude all of the partial patterns completely contained within this unit embroidery region Pn from subsequent target partial patterns (S89). For example, in the example shown in FIG. 20, although the size of the unit embroidery region P1 is not reduced, the partial pattern F11 is completely contained within this unit embroidery region P1, and thus is excluded from the target partial patterns.

Next, the CPU11 may add 1 to the target region counter n (S90) and determine whether the value of n is larger than the number-of-unit embroidery regions N, that is, whether the processing has been completed for all of the unit embroidery regions (S91). If the processing for all of the unit embroidery regions has not been completed (NO in S91), the CPU11 may return to S83 to perform the modification processing for the next unit embroidery region.

Figure 22:
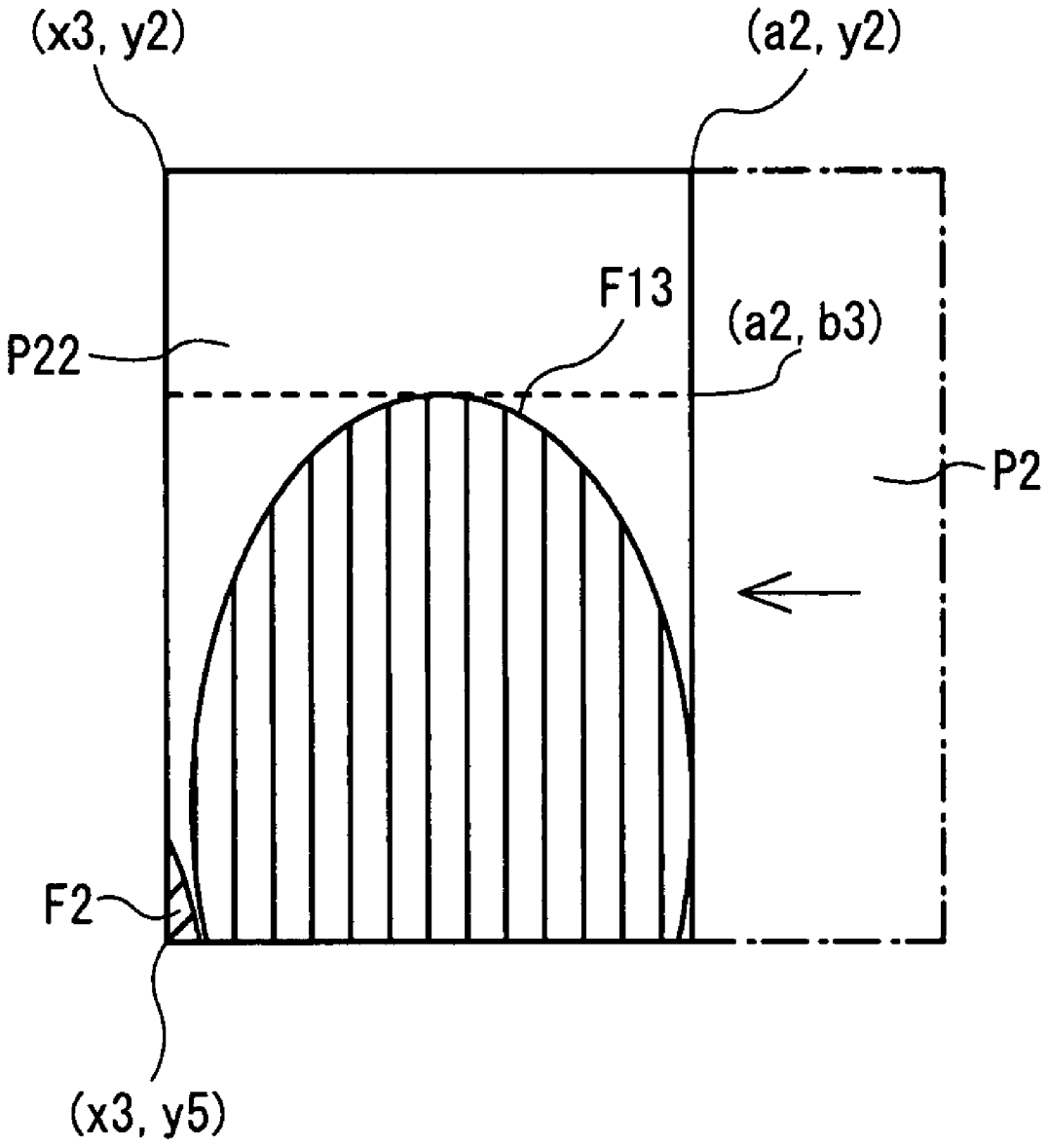
FIG. 22 is an explanatory illustration of another modification of the unit embroidery region.

The following will describe the second-loop processing and the subsequent processing shown in the example of FIG. 20. Because the partial pattern F11 has been excluded from the target partial patterns at the end of the processing for the unit embroidery region P1 (S89), only the partial patterns F12 and F13 are contained within the unit embroidery region P2 and so are processed next. Accordingly, a minimum rectangle BB that encloses the partial patterns F12 and F13 is calculated (S84), resulting in its lowest coordinate value being b1 (see FIG. 21), which is not contained within the unit embroidery region P2 in its height direction (NO in S85). Accordingly, the height of the unit embroidery region P2 is not reduced. Further, a rightmost coordinate value of the minimum rectangle BB is a2 (see FIG. 21), which is contained within the unit embroidery region P2 in its width direction (YES in S87). Therefore, as shown in FIG. 22, the width of the unit embroidery region P2 is reduced to the rightmost coordinate value of the rectangle BB (a2), using the upper left point (x3, y2) as a base point (S88), thus providing a modified unit embroidery region P22. It is to be noted that because there is no partial pattern contained within the unit embroidery region P2 completely, no processing is performed in S89.

Figure 23:
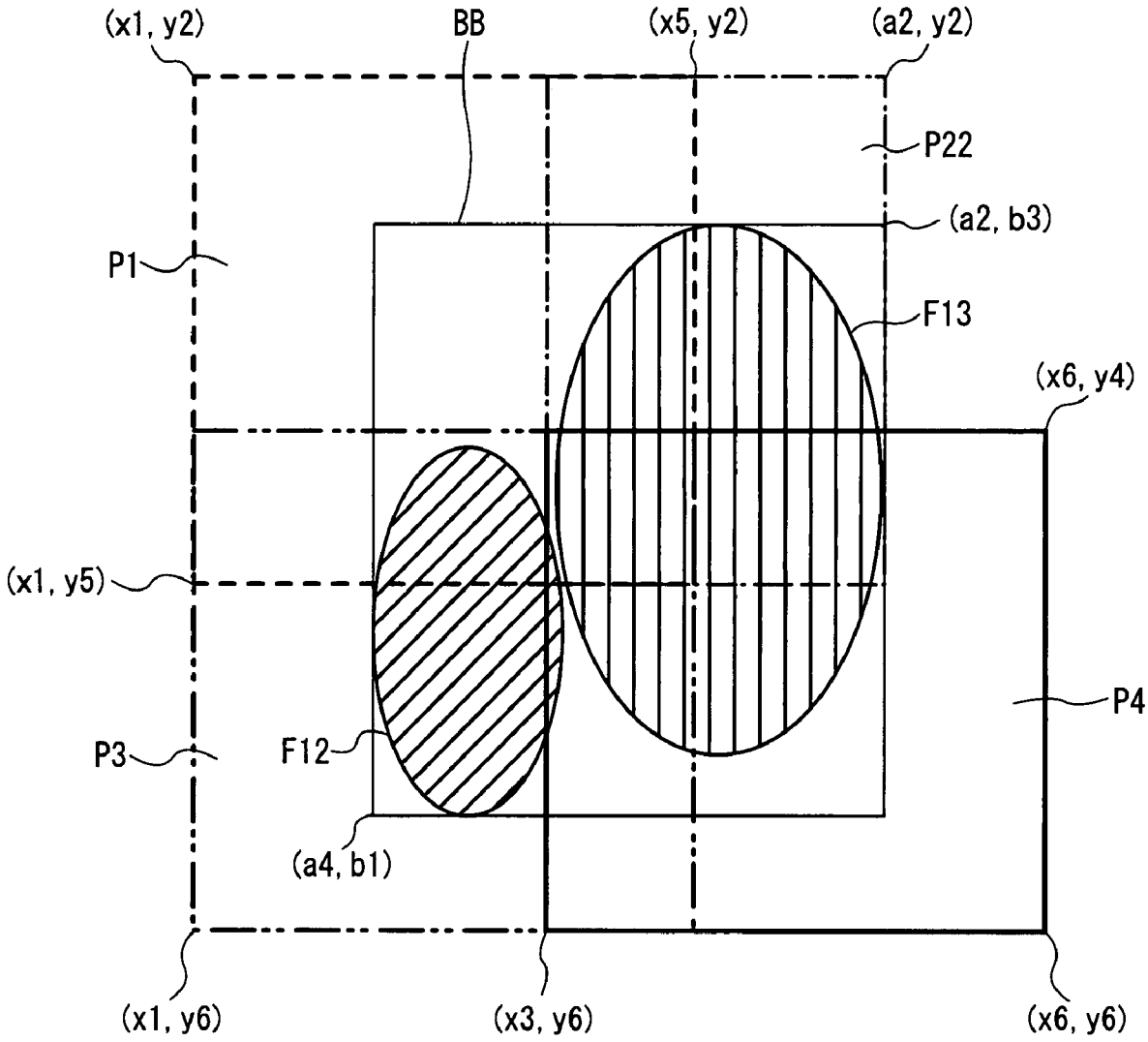
FIG. 23 is an explanatory illustration of a further modification of the unit embroidery regions.
Figure 24:
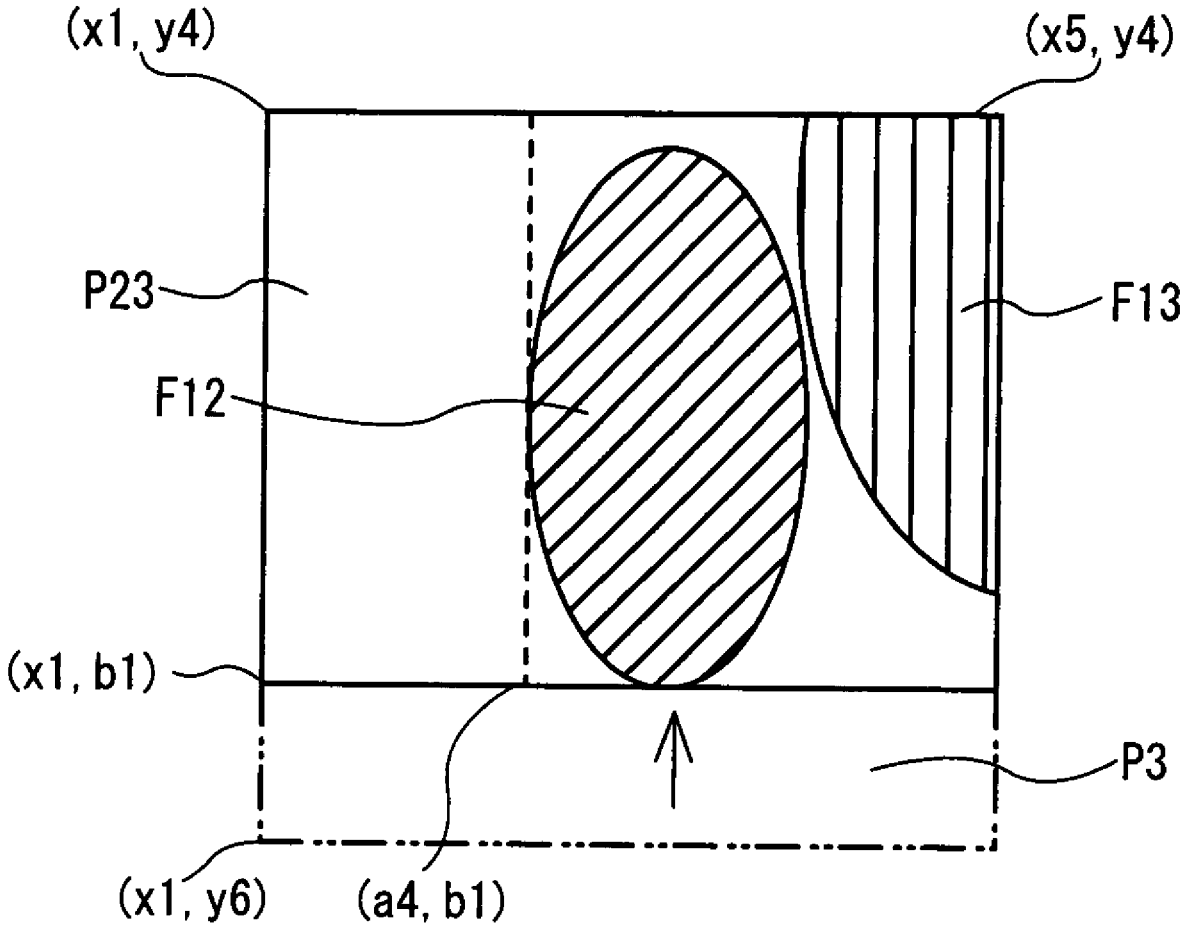
FIG. 24 is an explanatory illustration of a still further modification of the unit embroidery regions.

At the time of start of third-loop processing, the unit embroidery region P2 is already changed into the modified unit embroidery region P22, thus providing such a condition as shown in FIG. 23. Accordingly, the partial patterns F12 and F13 are contained within the unit embroidery region P3, so that a minimum rectangle BB that encloses these patterns is calculated (S84), resulting in its lowest coordinate value being b1, which is contained within the unit embroidery region P3 in its height direction (YES in S85). Therefore, as shown in FIG. 24, the height of the unit embroidery region P3 is reduced to the lowest coordinate value b1 of the minimum rectangle BB, using the upper left point (x1, y4) as the base point (S86), thus providing a modified unit embroidery region P23. Further, the rightmost coordinate value of the minimum rectangle BB is a2 and is not contained within the modified unit embroidery region P3 in its width direction (NO in S87), so that the width of the unit embroidery region P3 is not reduced. Then, the partial pattern F12 completely contained within this modified unit embroidery region P23 is excluded from the target partial patterns (S89).

Figure 25:
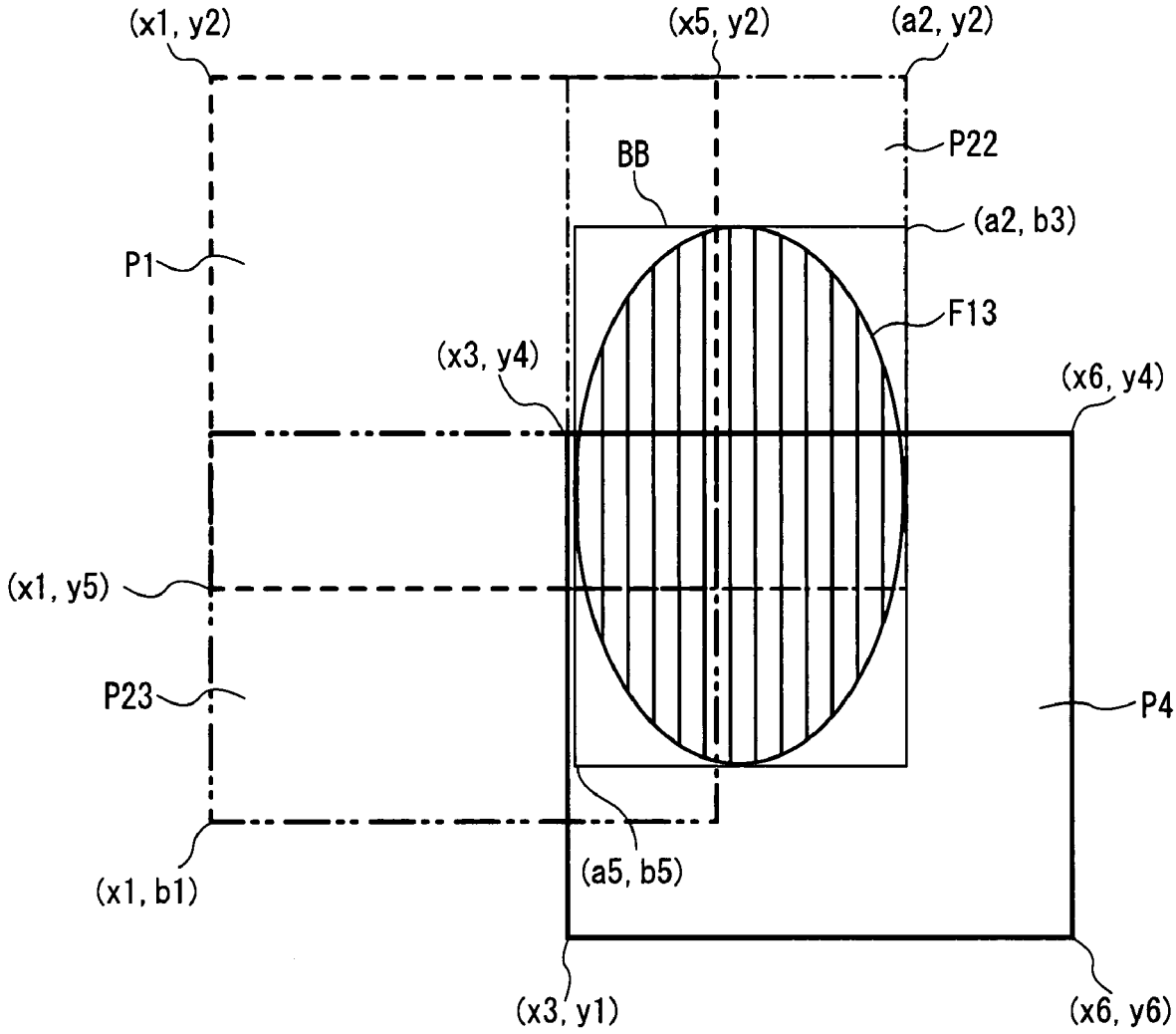
FIG. 25 is an explanatory illustration of an additional modification of the unit embroidery region.
Figure 26:
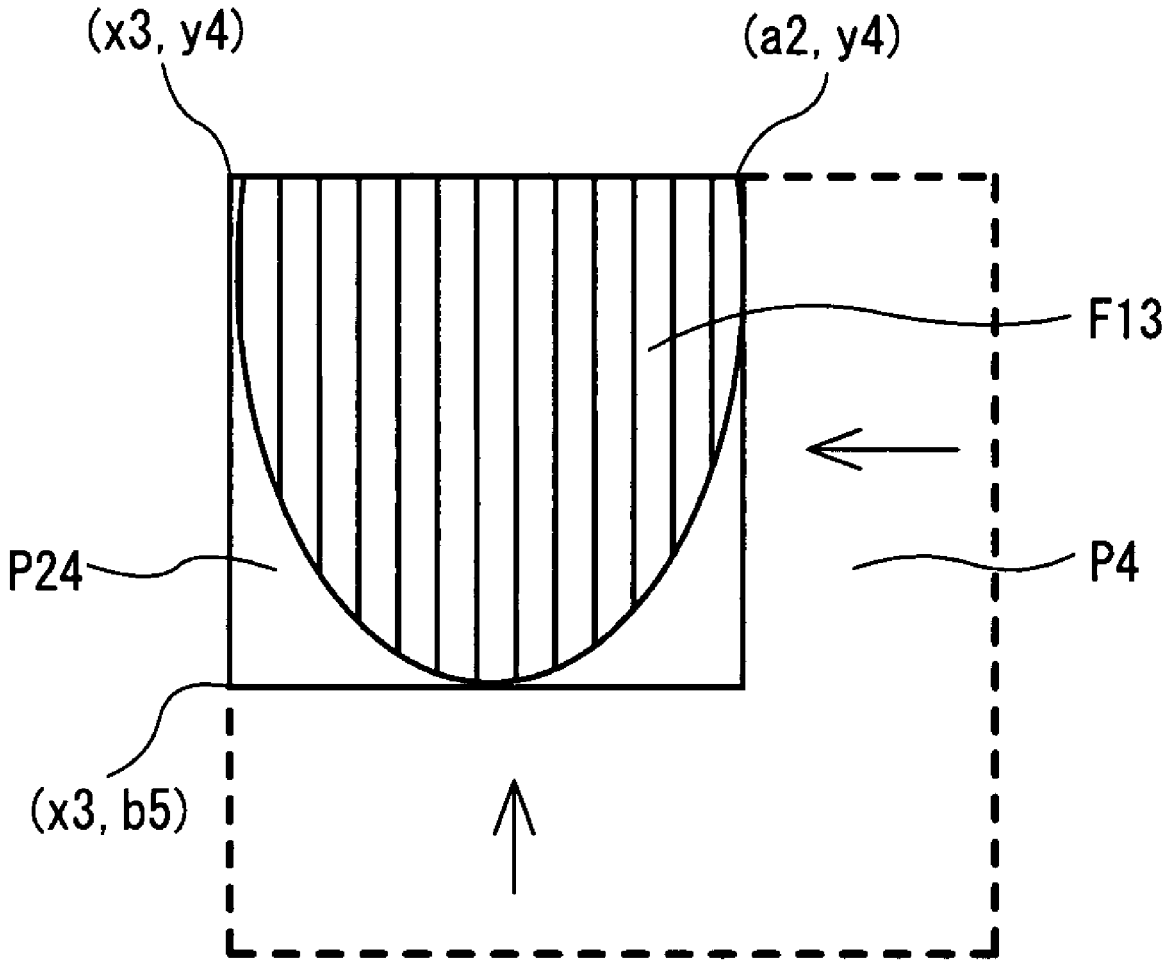
FIG. 26 is an explanatory illustration of an additional modification of the unit embroidery region.

During the fourth-loop processing, only the partial pattern F13 is to be processed and the unit embroidery region has been modified as shown in FIG. 25 as a result of the above processing. With this, a minimum rectangle BB that encloses the partial pattern F13, which is contained within the target unit embroidery region P4, is calculated (S84), resulting in its lowest coordinate value being b5, which is contained within the unit embroidery region P4 in its height direction (YES in S85). Therefore, as shown in FIG. 26, the height of the unit embroidery region P4 is reduced to the lowest coordinate value b5 of the minimum rectangle BB, using the upper left point (x3, y4) as the base point (S86), thus providing a modified unit embroidery region P24. Further, the rightmost coordinate value of the rectangle BB is a2 and contained within the unit embroidery region P4 in its width direction (YES in S87). Therefore, as shown in FIG. 26, the width of the unit embroidery region P4 is reduced to the rightmost coordinate value a2 of the minimum rectangle BB, using the upper left point (x3, y4) as the base point (S88), thus providing the modified unit embroidery region P24. Because no partial patterns are now contained within the unit embroidery region P4, no processing is performed at S89.

Figure 27:
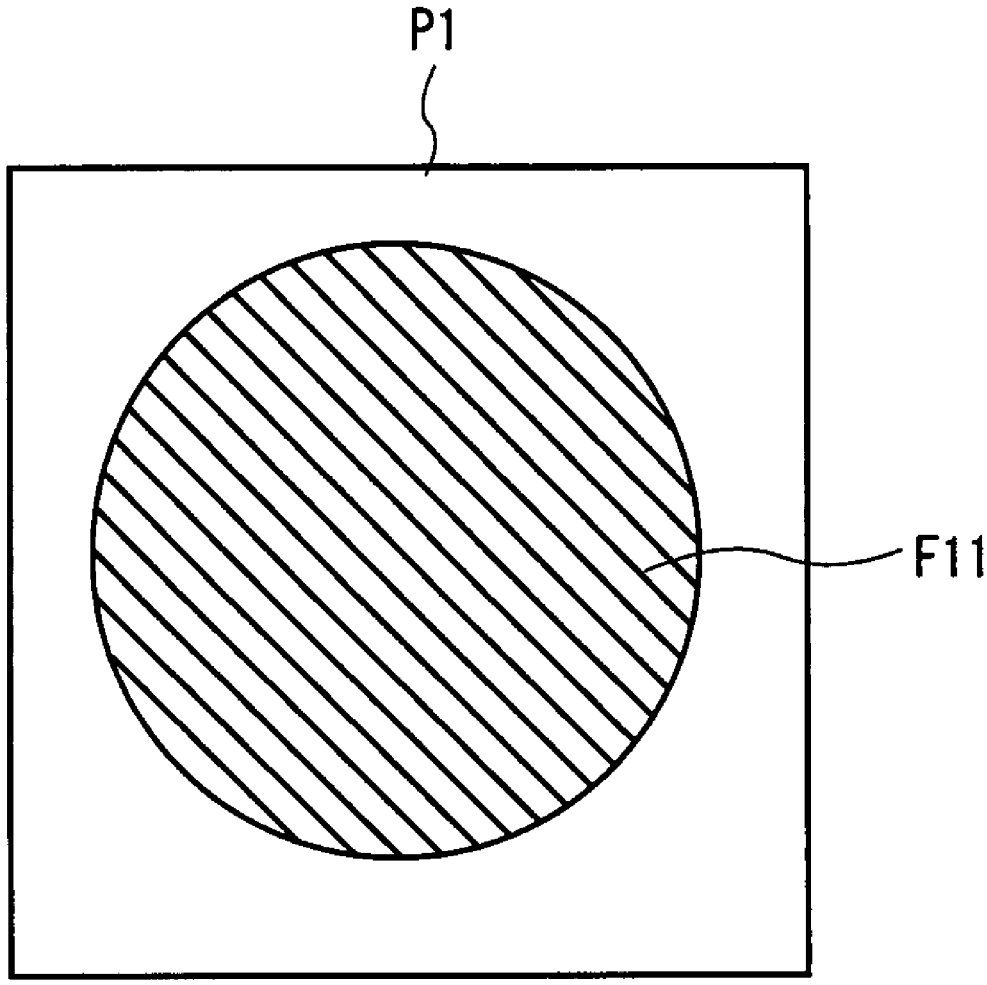
FIG. 27 is an explanatory illustration of a unit embroidery region after modification.
Figure 28:
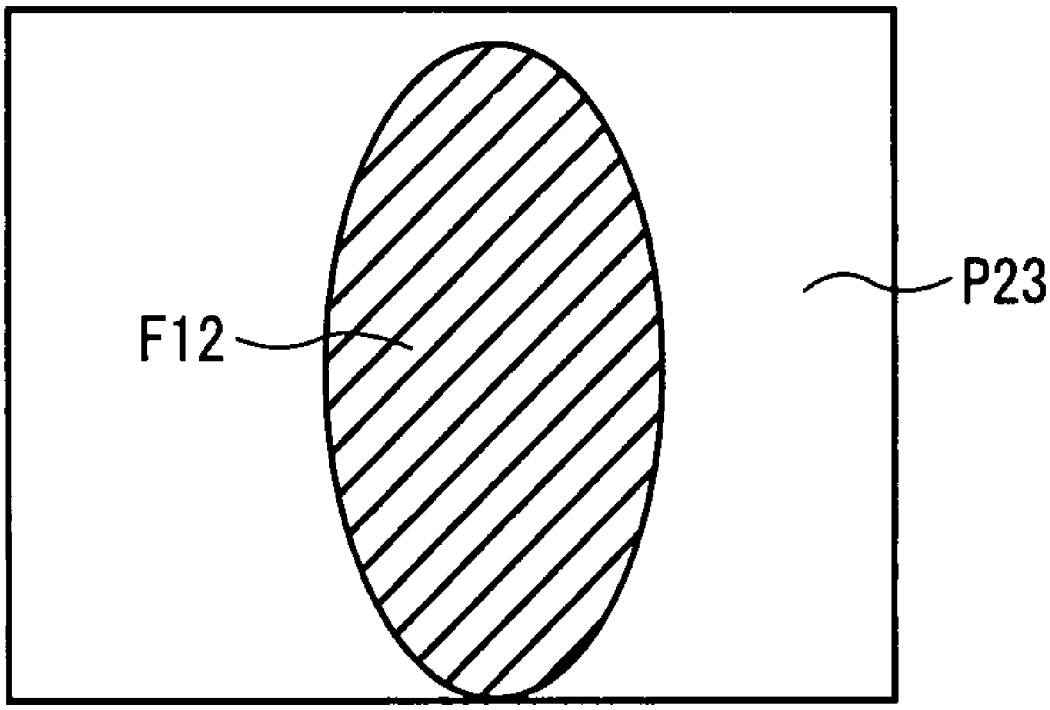
FIG. 28 is an explanatory illustration of another unit embroidery region after modification.
Figure 29:
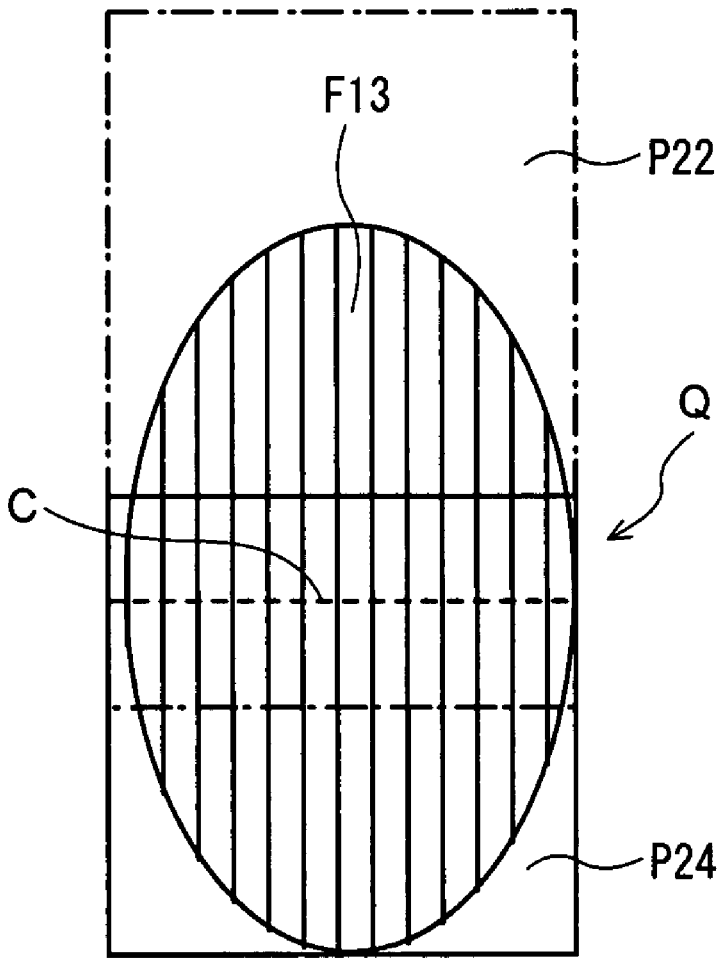
FIG. 29 is an explanatory illustration of a further unit embroidery region after modification.

Through the above processing, the initial unit embroidery regions P1 through P4 shown in FIG. 20 has been changed into the unit embroidery region P1 shown in FIG. 27, the unit embroidery region P23 shown in FIG. 28, and the unit embroidery regions P22 and P24 shown in FIG. 29, respectively.

If the processing has been performed as described above, on all of the unit embroidery regions (YES in S91), the CPU11 may then determine whether there is any of the partial patterns that is not completely contained within each of the unit embroidery regions (S92). If there are no partial patterns that are not completely contained (NO in S92), the CPU11 may directly end the unit embroidery region modification processing, and return to the unit embroidery region setting processing.

If there are any partial patterns that are not completely contained within the unit embroidery regions (YES in S92), the CPU11 may set the number of these patterns (target partial patterns) to the number-of-target-partial patterns K (S93) and a counter k to 1 (S94), thus sequentially allocating the target partial patterns into the unit embroidery regions. Specifically, the CPU11 may divide the target partial pattern at a centerline of an overlapping region of the adjacent unit embroidery regions over which this pattern extends (S95). Then, it may add 1 to a value of k (S96) to repeat the processing of S95 until the value of k exceeds the number-of-target-partial patterns K, that is, as long as the allocation processing has not been completed for all of the partial patterns to be processed (NO in S97). If the processing is completed for all of the target partial patterns (YES in S97), the CPU11 may end the unit embroidery region modification processing and return to the unit embroidery region setting processing.

Figure 30:
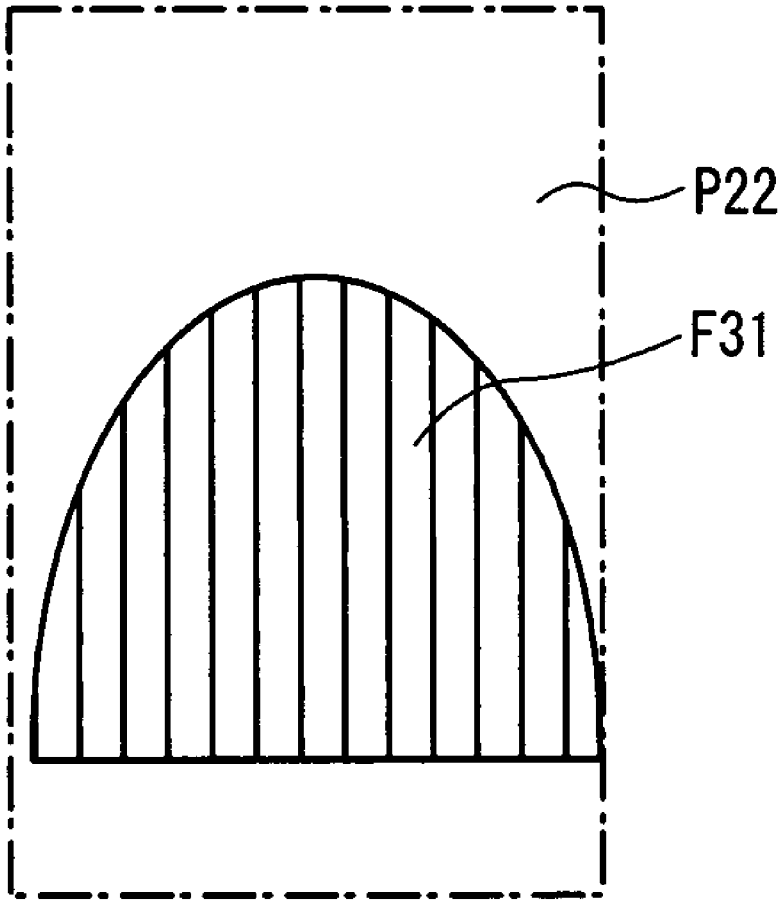
FIG. 30 is an explanatory illustration of a division of a partial pattern.
Figure 31:
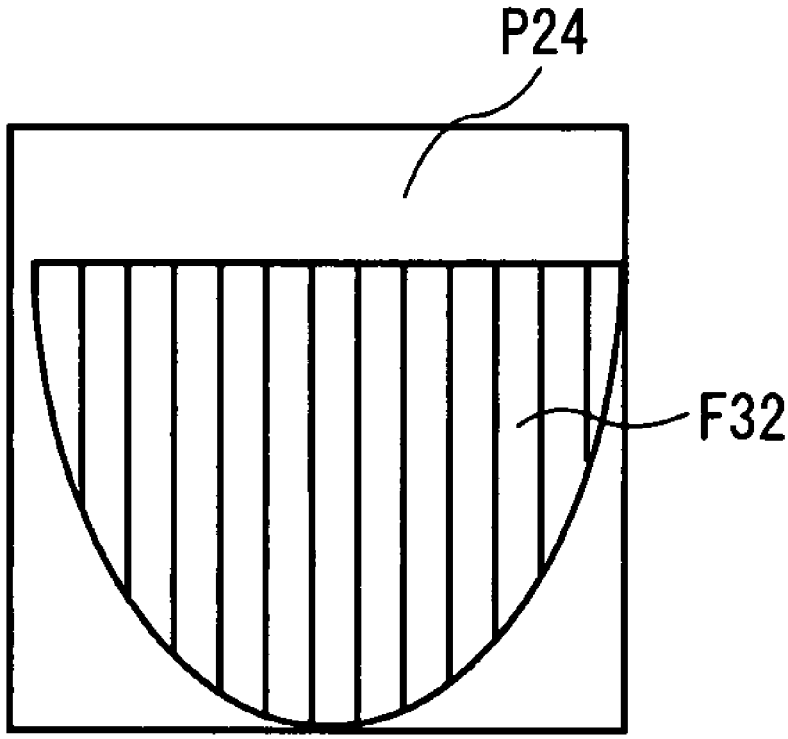
FIG. 31 is an explanatory illustration of another division of the partial pattern.

In the respective examples of FIGS. 27 and 28, the partial patterns F11 and F12 are completely contained within the unit embroidery regions P1 and P23, respectively, whereas the partial pattern F13 extends over the unit embroidery regions P22 and P24 as shown in FIG. 29 (YES in S92). Therefore, the number of the partial patterns not completely contained within the unit embroidery regions is 1 (S93). Next, the CPU11 divides the target partial pattern F13 at a centerline C of an overlapping region Q of the adjacent unit embroidery regions P22 and P24 over which this partial pattern F13 extends. The CPU11 then allocates divided partial patterns F31 and F32 into the unit embroidery regions P22 and P24 as shown in FIGS. 30 and 31, respectively (S95). As a result, data pieces of the allocated partial patterns F31 and F32 are created in the unit embroidery regions P22 and P24, respectively (S15 in FIG. 5).

As described above, by setting a size of an initial unit embroidery region to a maximum sewing size determined by an embroidery frame and reducing it in such a manner so as to match each of the height and the width of the partial patterns contained within the set unit embroidery region, the unit embroidery region may be made to have an appropriate size. As a result, the partial patterns may less likely to be divided to create several regional pattern data and so may be sewn as one embroidery, thereby improving a quality of the products.

In the embroidery data processing apparatus of the present disclosure, in creation of embroidery data of an embroidery pattern that includes a plurality of partial patterns, the region setting device may set a plurality of unit embroidery regions. Each of the unit embroidery regions may have a size not larger than an upper limit of a size of the maximum sewing region stored in the storage device, so that the region modification device may modify the size of each of the unit embroidery regions based on a position and a size of the partial patterns and a size of the maximum sewing region. Then, the data creation device may create embroidery data of a part or a whole of the embroidery pattern contained within the modified embroidery regions. Therefore, if each of the partial patterns is completely contained within the maximum sewing region, the embroidery data may be created without dividing them. As a result, the number of times of replacing a work cloth attached to the embroidery frame may be decreased to a minimum required value, thereby mitigating labor involved in sewing. Further, the number of the partial patterns to be divided may be reduced to a minimum required value, thereby inhibiting degradation in sewing quality owing to the division.

In the embroidery data processing apparatus of the present disclosure, a first determination device may determine whether a partial pattern protrudes from a set unit embroidery region. If it is determined that the pattern protrudes, the region modification device may expand the size of the unit embroidery region to an upper limit of the size of the maximum sewing region so that it completely contains the partial pattern. Therefore, even if a partial pattern protrudes from an initially set unit embroidery region, the partial pattern may be set so as to be sewn within one unit embroidery region unless this pattern extends from the maximum sewing region.

Further, in the embroidery data processing apparatus of the present disclosure, a second determination device may determine whether a partial pattern is completely contained within the unit embroidery region. If the partial pattern is completely contained within the unit embroidery region, the region modification device may reduce the size of the unit embroidery region to a lower limit of such a size so that this partial pattern is completely contained. Therefore, by initially setting a size of a unit embroidery region to a maximum sewing region and then reducing it to such a minimum size that the partial pattern is completely contained, embroidery data of that partial pattern may be created.

In the embroidery data processing apparatus of the present disclosure, a region modification device may modify a height and a width of the unit embroidery region independently of each other. Therefore, if a partial pattern protrudes from the unit embroidery region only in a height direction or in a width direction, or if only a height or a width of the unit embroidery region may be reduced, an appropriate modified unit embroidery region may be set so as to match a size of the partial pattern.

Further, in the embroidery data processing apparatus of the present disclosure, a third determination device may determine whether a part of the partial pattern is contained within a unit embroidery region. If a part of the partial pattern is contained, the region modification device may reduce at least one of a height and a width of this unit embroidery region to such a minimum size that the pattern is completely contained within this unit embroidery region at least within a height direction or within a width direction. Therefore, even if a part of a partial pattern is contained either within the height direction or within the width direction, an appropriate modified unit embroidery region may be set.

In the embroidery data processing program of the present disclosure, in creation of embroidery data of an embroidery pattern that includes a plurality of partial patterns, in a region setting step, a plurality of unit embroidery regions may be set, each of which may have a size not larger than an upper limit of a size of the maximum sewing region stored in the storage step. Then, in the region modification step, the size of each of the unit embroidery regions set in the region setting step may be modified, based on a position and a size of the partial patterns and a size of the maximum sewing region. Then, embroidery data of a part or a whole of the embroidery pattern contained within the modified embroidery regions may be created in the data creation step. Therefore, if each of the partial patterns is completely contained within the maximum sewing region, the embroidery data may be created without dividing them. As a result, the number of times of replacing a work cloth attached to the embroidery frame may be decreased to a minimum required value, thereby mitigating labor involved in sewing. Further, the number of the partial patterns to be divided may be reduced to a minimum required value, thereby inhibiting degradation in sewing quality owing to the division.

In the embroidery data processing program of the present disclosure, in a first determination step, whether a partial pattern protrudes from a set unit embroidery region may be determined. If it is determined in the first determination step that the pattern protrudes, in a region modification step, the size of the unit embroidery region may be expanded to an upper limit of the size of the maximum sewing region so that it completely contains the partial pattern. Therefore, even if a partial pattern protrudes from an initially set unit embroidery region, the partial pattern may be set so as to be sewn within one unit embroidery region unless this pattern extends from the maximum sewing region.

In the embroidery data processing program of the present disclosure, in the second determination step, whether a partial pattern is completely contained within a unit embroidery region may be determined. Then, if the partial pattern is completely contained, in the region modification step, the size of the unit embroidery region may be reduced to a lower limit of such a size that the partial pattern is still completely contained. Therefore, by initially setting a size of a unit embroidery region to a maximum sewing region and then reducing it to such a minimum size that the partial pattern is still completely contained, embroidery data of that partial pattern may be created.

Further, in the embroidery data processing program of the present disclosure, in the region modification step, a height and a width of a unit embroidery region may be modified independently of each other. Therefore, if a partial pattern protrudes from the unit embroidery region only in a height direction or in a width direction, or if only a height or a width of the unit embroidery region may be reduced, an appropriate modified unit embroidery region may be set so as to match a size of the partial pattern.

In the embroidery data processing program of the present disclosure, in a third determination step, it may determine whether a part of a partial pattern is contained within a unit embroidery region. If it is contained, in the region modification step, at least one of a height and a width of this unit embroidery region may be reduced to such a minimum size that the partial pattern is completely contained within the unit embroidery region at least within a height direction or within a width direction. Therefore, even if a part of a partial pattern is contained either within the height direction or within the width direction, an appropriate modified unit embroidery region may be set.

In the embroidery data processing apparatus of the present disclosure, in the creation of embroidery data of an embroidery pattern that includes a plurality of partial patterns, a control device may set a plurality of unit embroidery regions, each having a size not larger than an upper limit of a size of the maximum sewing region stored in the storage device, and may modify the size of each of the unit embroidery regions based on a position, a size of the partial patterns and a size of the maximum sewing region. Then, the data creation device may create embroidery data of a part of or a whole embroidery pattern contained within the modified embroidery regions. Therefore, if each of the partial patterns is completely contained within the maximum sewing region, the embroidery data may be created without dividing them. As a result, the number of times of replacing a work cloth attached to the embroidery frame may be decreased to a minimum required value, thereby mitigating labor involved in sewing. Further, the number of the partial patterns to be divided may be reduced to a minimum required value, thereby inhibiting degradation in sewing quality owing to the division.

Further, in the embroidery data processing apparatus of the present disclosure, the control device may determine whether a partial pattern protrudes from a set unit embroidery region. If having determined that the pattern protrudes, the control device may expand the size of the unit embroidery region to an upper limit of a size of the maximum sewing region so that it completely contains the partial pattern. Therefore, even if a partial pattern protrudes from an initially set unit embroidery region, the partial pattern may be set so as to be sewn within one unit embroidery region unless this pattern extends from the maximum sewing region.

In the embroidery data processing apparatus of the disclosure, the control device may determine whether a partial pattern is completely contained within a unit embroidery region. If the partial pattern is contained within the unit embroidery region, the control device may reduce the size of the unit embroidery region to a lower limit so that this partial pattern is still completely contained. Therefore, by initially setting a size of a unit embroidery region to a maximum sewing region and then reducing it to such a minimum size that the partial pattern is still completely contained, embroidery data of that partial pattern may be created.

In the embroidery data processing apparatus of the present disclosure, the control device may modify a height and a width of a unit embroidery region independently of each other. Therefore, if a partial pattern protrudes from the unit embroidery region only in a height direction or a width direction, or if only a height or a width may be reduced, an appropriate unit embroidery region may be set so as to match a size of the partial pattern.

Further, in the embroidery data processing apparatus of the present disclosure, the control device may determine whether a part of the partial pattern is contained within a unit embroidery region. If a part of the partial pattern is contained, the control device may reduce at least one of a height and a width of this unit embroidery region to such a minimum size that the pattern is completely contained within this unit embroidery region at least in a height direction or in a width direction. Therefore, even if a part of a partial pattern is contained within either the height direction or the width direction, an appropriate modified unit embroidery region may be set.

Although the disclosure has been described with reference to exemplary embodiments, it is to be understood that the disclosure is not limited to the exemplary embodiments or structures. While the various elements of the exemplary embodiments are shown in various combinations and configurations, which are exemplary, other combinations and configurations, including more, less or only a single element, are also within the spirit and scope of the disclosure.

What is claimed is:

1. An embroidery data processing apparatus that creates embroidery data used by an embroidery sewing machine to sew an embroidery pattern, the embroidery pattern including a plurality of partial patterns, comprising:

a storage device that stores a maximum sewing region, a size of the maximum sewing region having an upper limit;

a region setting device that sets a plurality of unit embroidery regions partially overlapping with each other, each of the plurality of unit embroidery regions having a size not larger than the upper limit of the maximum sewing region stored in the storage device;

a region modification device that modifies at least one of a height and a width of each of the plurality of unit embroidery regions set by the region setting, device by an amount that is determined in accordance with a position and a size of the plurality of partial patterns, on condition that a size of the each of the plurality of unit embroidery regions after modification does not exceed the upper limit of the maximum sewing region, a part or a whole of the each of the plurality of partial patterns being contained within the plurality of unit embroidery regions;

a data creation device that creates the embroidery data of a part or a whole of the embroidery pattern being contained within the plurality of unit embroidery regions modified by the region modification device; and an output device that outputs the embroidery data created by the data creation device.

2. The embroidery data processing apparatus according to claim 1, further comprising:

a first determination device that determines whether at least one partial pattern protrudes from one of the plurality of unit embroidery regions set by the region setting device, wherein if the first determination device determines that the at least one partial pattern protrudes from the one of the plurality of unit embroidery regions, the region modification device increases at least one of a height and a width of the one of the plurality of unit embroidery regions so that a whole of the at least one partial pattern is contained within the one of the plurality of unit embroidery regions.

3. The embroidery data processing apparatus according to claim 1, further comprising:

a second determination device that determines whether at least one partial pattern is completely contained within one of the plurality of unit embroidery regions set by the region setting device, wherein if the second determination device determines that the at least one partial pattern is completely contained within the one of the plurality of unit embroidery regions, the region modification device reduces at least one of a height and a width of the one of the plurality of unit embroidery regions so that the partial pattern is completely contained within the one of the plurality of unit embroidery regions.

4. The embroidery data processing apparatus according to claim 1, wherein the region modification device modifies a height and a width of the each of the plurality of unit embroidery regions independently of each other.

5. The embroidery data processing apparatus according to claim 1, further comprising:

a third determination device that determines whether a part of at least one partial pattern is contained within one of the plurality of unit embroidery regions set by the region setting device, wherein if the third determination device determines that the part of the at least one partial pattern is contained within the one of the plurality of unit embroidery regions, the region modification device reduces at least one of a height and a width of the one of the plurality of unit embroidery regions so that the at least one partial pattern is completely contained within the one of the plurality of unit embroidery regions at least in a height direction or in a width direction.

6. The embroidery data processing apparatus according to claim 1, wherein the maximum sewing region corresponds to a size of an embroidery frame used by the embroidery sewing machine to sew.

7. A computer-executable embroidery data processing program recorded on a computer-readable medium, the program usable to create embroidery data used by an embroidery sewing machine to sew an embroidery pattern, the embroidery pattern including a plurality of partial patterns, the program comprising:

instructions for storing a maximum sewing region, a size of the maximum sewing region having an upper limit;

instructions for setting a plurality of unit embroidery regions partly overlapping with each other, each of the plurality of unit embroidery regions having a size not larger than the upper limit of the maximum sewing region stored in the instructions for storing;

instructions for modifying at least one of a height and a width of each of the plurality of unit embroidery regions set in the instructions for setting by an amount that is determined in accordance with a position and a size of the plurality of partial patterns, on condition that a size of the each of the plurality of unit embroidery regions after modification does not exceed the upper limit of the maximum sewing region, a part or a whole of the each of the plurality partial patterns being contained within the plurality of unit embroidery regions;

instructions for creating embroidery data of a part or a whole of the embroidery pattern being contained within the plurality of unit embroidery regions modified in the instructions for modifying; and instructions for outputting the embroidery data created in the instructions for creating.

8. The embroidery data processing program according to claim 7, further comprising:

instructions for first determining whether at least one partial pattern protrudes from one of the plurality of unit embroidery regions set in the instructions for setting, wherein if it is determined in the instructions for first determining that the at least one partial pattern protrudes from the one of the plurality of unit embroidery regions, at least one of a height and a width of the one of the plurality of the unit embroidery regions is increased so that a whole of the at least one partial pattern is contained within the one of the plurality of unit embroidery regions in the instructions for modifying.

9. The embroidery data processing program according to claim 7, further comprising:

instructions for second determining whether at least one partial pattern is completely contained within one of the plurality of unit embroidery regions set in the instructions for setting, wherein if it is determined in the instructions for second determining that the at least one partial pattern is completely contained within the one of the plurality of unit embroidery regions, at least one of a height and a width of the one of the plurality of unit embroidery regions is reduced so that the at least one partial pattern is completely contained in the instructions for modifying.

10. The embroidery data processing program according to claim 7, wherein a height and a width of the each of the plurality of unit embroidery regions is modified independently of each other in the instructions for modifying.

11. The embroidery data processing program according to claim 7, further comprising:

instructions for third determining whether a part of at least one partial pattern is contained within one of the plurality of unit embroidery regions set in the instructions for setting, wherein if it is determined in the instructions for third determining that the part of the at least one partial pattern is contained within the one of the plurality of unit embroidery regions, at least one of a height and a width of the one of the plurality of unit embroidery regions is reduced in the instructions for modifying so that the at least one partial pattern is completely contained within the one of the plurality of unit embroidery regions at least in a height direction or in a width direction.

12. The embroidery data processing program according to claim 7, wherein the maximum sewing region corresponds to a size of an embroidery frame used by the embroidery sewing machine to sew.

13. An embroidery data processing apparatus that creates embroidery data used by an embroidery sewing machine to sew an embroidery pattern, the embroidery pattern including a plurality of partial patterns, comprising:

a storage device that stores a maximum sewing region, a size of the maximum sewing region having an upper limit;

a control device that sets a plurality of unit embroidery regions partly overlapping with each other, each of the plurality of unit embroidery regions having a size not larger than the upper limit of a size of the maximum sewing region stored in the storage device, modifies at least one of a height and a width of each of the plurality of unit embroidery regions by an amount that is determined in accordance with a position and a size of the plurality of partial patterns, on condition that a size of the each of the plurality of unit embroidery regions after modification does not exceed the upper limit of the maximum sewing region, a part or a whole of the each of the plurality of partial patterns being contained within the plurality of unit embroidery regions, and creates the embroidery data of a part or a whole of the embroidery pattern being contained within the plurality of unit embroidery regions after modification; and an output device that outputs the embroidery data created by the control device.

14. An embroidery data processing apparatus according to claim 13, wherein the control device determines whether at least one partial pattern protrudes from one of the plurality of unit embroidery regions and, if having determined that the at least one partial pattern protrudes from the one of the plurality of unit embroidery regions, increases at least one of a height and a width of the one of the plurality of unit embroidery regions so that a whole of the at least one partial pattern is contained within the one of the plurality of unit embroidery regions.

15. The embroidery data processing apparatus according to claim 13, wherein the control device determines whether at least one partial pattern is completely contained within one of the plurality of unit embroidery regions and, if having determined that the at least one partial pattern is completely contained within the one of the plurality of unit embroidery regions, reduces at least one of a height and a width of the one of the plurality of unit embroidery regions so that the at least one partial pattern is completely contained in the one of the plurality of unit embroidery regions.

16. The embroidery data processing apparatus according to claim 13, wherein the control device modifies a height and a width of the each of the plurality of unit embroidery regions independently of each other.

17. The embroidery data processing apparatus according to claim 13, wherein the control device determines whether a part of at least one partial pattern is contained within one of the plurality of unit embroidery regions and, if having determined that the part of the at least one partial pattern is contained within the one of the plurality of unit embroidery regions, reduces at least one of a height and a width of the one of the plurality of unit embroidery regions so that the at least one partial pattern is completely contained within the one of the plurality of unit embroidery regions at least in a height direction or in a width direction.

18. The embroidery data processing apparatus according to claim 13, wherein the maximum sewing region corresponds to a size of an embroidery frame used by the embroidery sewing machine to sew.

* * * * *